US010603558B2

(12) United States Patent
Dingman et al.

(10) Patent No.: US 10,603,558 B2
(45) Date of Patent: Mar. 31, 2020

(54) GOLF CLUB GRIP WITH SENSOR HOUSING

(71) Applicant: SSG International, LLC, Wixom, MI (US)

(72) Inventors: Dean Dingman, Brighton, MI (US); Steven Ogg, Carlsbad, CA (US); Ryan Crisp, Lewis Center, OH (US)

(73) Assignee: SSG International, LLC, Wixom, MI (US)

( * ) Notice: Subject to any disclaimer, the term of this patent is extended or adjusted under 35 U.S.C. 154(b) by 0 days.

(21) Appl. No.: 16/135,062

(22) Filed: Sep. 19, 2018

(65) Prior Publication Data

US 2019/0176004 A1 Jun. 13, 2019

Related U.S. Application Data

(63) Continuation of application No. 15/834,145, filed on Dec. 7, 2017, now Pat. No. 10,099,101.

(51) Int. Cl.

| | |
|---|---|
| ***A63B 60/10*** | (2015.01) |
| ***A63B 60/16*** | (2015.01) |
| ***A63B 60/14*** | (2015.01) |
| ***A63B 53/14*** | (2015.01) |

(52) U.S. Cl.

CPC ..... *A63B 60/10* (2015.10); *A63B 53/14* (2013.01); *A63B 60/14* (2015.10); *A63B 60/16* (2015.10); *A63B 2220/10* (2013.01); *A63B 2220/24* (2013.01); *A63B 2220/833* (2013.01)

(58) Field of Classification Search

CPC ..... A63B 53/14; A63B 53/007; A63B 60/10; A63B 2220/833

USPC ..... 473/206

See application file for complete search history.

(56) References Cited

U.S. PATENT DOCUMENTS

| | | | |
|---|---|---|---|
| 1,528,190 | A | 3/1925 | Howe |
| 1,634,082 | A | 6/1927 | Rigby |
| 1,634,887 | A | 7/1927 | Rigby |
| 1,709,546 | A | 4/1929 | Stanton |
| 2,004,968 | A | 6/1935 | Young |
| 2,014,829 | A | 9/1935 | Young |

(Continued)

FOREIGN PATENT DOCUMENTS

| | | | |
|---|---|---|---|
| JP | 2003190334 | A | 7/2003 |
| JP | 2005168998 | A | 6/2005 |

(Continued)

OTHER PUBLICATIONS

International Search Report dated Dec. 19, 2018 for international filing PCT/US2018/054130 filed Oct. 3, 2018.

*Primary Examiner* — Michael D Dennis

(74) *Attorney, Agent, or Firm* — Harness, Dickey & Pierce, P.L.C.

(57) ABSTRACT

A golf club grip for a golf club includes an elongated member having a first end, a second end, an inner surface and an outer surface. The first end is configured to receive a golf club shaft. The second end includes a recessed opening. The recessed opening extends away from the second end longitudinally toward the first end. A sensor housing comprising a first portion and a second portion. The first portion is received within the recessed opening. The first portion couples the sensor housing to the elongated member. The second portion receives a removable housing therein.

22 Claims, 16 Drawing Sheets

(56) References Cited

U.S. PATENT DOCUMENTS

| | | | |
|---|---|---|---|
| 2,178,872 | A | 11/1939 | Engstrom |
| 2,301,369 | A | 11/1942 | Carvill |
| 2,593,368 | A | 4/1952 | Verderber |
| 3,062,549 | A | 11/1962 | Duden |
| 3,219,348 | A | 11/1965 | Dishner |
| 3,252,706 | A | 5/1966 | Rosasco |
| 3,516,674 | A | 6/1970 | Rogacki |
| 3,589,731 | A | 6/1971 | Chancellor, Jr. |
| 3,606,326 | A | 9/1971 | Sparks |
| 3,625,517 | A | 12/1971 | Durnack |
| 3,625,518 | A | 12/1971 | Solheim |
| 3,771,794 | A | 11/1973 | Crockett |
| 3,791,652 | A | 2/1974 | Schuler |
| 3,815,910 | A | 6/1974 | Raines |
| 3,815,921 | A | 6/1974 | Turner |
| 3,995,856 | A | 12/1976 | Hollendorfer, Jr. |
| D243,355 | S | 2/1977 | Spencer |
| D244,100 | S | 4/1977 | Spencer |
| 4,022,470 | A | 5/1977 | Vidal |
| D245,797 | S | 9/1977 | Hollendorfer |
| 4,063,737 | A | 12/1977 | Tom et al. |
| 4,139,196 | A | 2/1979 | Riley |
| 4,186,924 | A | 2/1980 | Southey |
| 4,239,216 | A | 12/1980 | Bauer |
| D258,750 | S | 3/1981 | Hallaman et al. |
| 4,272,077 | A | 6/1981 | Spivey |
| D259,802 | S | 7/1981 | Williams |
| 4,327,916 | A | 5/1982 | Shiratori |
| D268,944 | S | 5/1983 | Southey |
| 4,461,479 | A | 7/1984 | Mitchell |
| 4,498,673 | A | 2/1985 | Swanson |
| 4,506,888 | A | 3/1985 | Nardozzi, Jr. |
| 4,597,578 | A | 7/1986 | Lancaster |
| 4,600,195 | A | 7/1986 | Hunter |
| 4,628,698 | A | 12/1986 | Needham et al. |
| 4,671,513 | A | 6/1987 | Swanson |
| 4,679,791 | A | 7/1987 | Hull |
| 4,735,414 | A | 4/1988 | Williams et al. |
| 4,746,120 | A | 5/1988 | Mockovak |
| 4,756,534 | A | 7/1988 | Thompson |
| 4,804,184 | A | 2/1989 | Maltby |
| 4,822,052 | A | 4/1989 | Dimmick et al. |
| 4,826,168 | A | 5/1989 | McGuire et al. |
| 4,878,667 | A | 11/1989 | Tosti |
| 4,905,147 | A | 2/1990 | Logg |
| 4,905,168 | A | 2/1990 | McCarthy et al. |
| 4,930,074 | A | 5/1990 | McCarthy |
| 4,944,515 | A | 7/1990 | Shearer |
| 4,979,743 | A | 12/1990 | Sears |
| 4,988,102 | A | 1/1991 | Reisner |
| 5,118,112 | A | 6/1992 | Bregman et al. |
| 5,152,527 | A | 10/1992 | Mather et al. |
| 5,169,152 | A | 12/1992 | Marquardt |
| 5,203,561 | A | 4/1993 | Lanctot |
| 5,209,474 | A | 5/1993 | Voyer |
| 5,213,329 | A | 5/1993 | Okumoto et al. |
| 5,228,688 | A | 7/1993 | Davis |
| 5,239,158 | A | 8/1993 | Locklear et al. |
| 5,267,733 | A | 12/1993 | Szokola |
| 5,322,290 | A | 6/1994 | Minami |
| 5,326,105 | A | 7/1994 | Fenton, Jr. |
| 5,340,106 | A | 8/1994 | Ravaris |
| 5,351,952 | A | 10/1994 | Hackman |
| 5,364,102 | A | 11/1994 | Appledorn |
| 5,373,138 | A | 12/1994 | Locklear et al. |
| 5,433,441 | A | 7/1995 | Olsen et al. |
| 5,438,518 | A | 8/1995 | Bianco et al. |
| 5,441,256 | A | 8/1995 | Hackman |
| 5,465,967 | A | 11/1995 | Boeckenhaupt |
| 5,542,676 | A | 8/1996 | Howe, Jr. et al. |
| 5,547,189 | A | 8/1996 | Billings |
| 5,573,469 | A | 11/1996 | Dekura |
| 5,575,473 | A | 11/1996 | Turner |
| 5,595,544 | A | 1/1997 | Roelke |
| 5,632,694 | A | 5/1997 | Lee |
| 5,632,695 | A | 5/1997 | Hlinka et al. |
| 5,682,230 | A | 10/1997 | Anfinsen et al. |
| 5,728,006 | A | 3/1998 | Teitell et al. |
| 5,735,754 | A | 4/1998 | Antonious |
| 5,741,193 | A | 4/1998 | Nolan |
| 5,749,792 | A | 5/1998 | Engfer et al. |
| 5,766,088 | A | 6/1998 | Severtsen |
| 5,779,555 | A | 7/1998 | Nomura et al. |
| 5,779,559 | A | 7/1998 | Eberle |
| 5,779,565 | A | 7/1998 | Adams |
| 5,792,000 | A | 8/1998 | Weber et al. |
| 5,800,281 | A | 9/1998 | Gilbert |
| 5,813,920 | A | 9/1998 | Rife |
| 5,826,874 | A | 10/1998 | Teitell et al. |
| 5,879,241 | A | 3/1999 | Cook et al. |
| D408,461 | S | 4/1999 | Lamkin |
| 5,931,745 | A | 8/1999 | Adams |
| 5,941,779 | A | 8/1999 | Zeiner-Gundersen |
| 5,952,921 | A | 9/1999 | Donnelly |
| 5,984,798 | A | 11/1999 | Gilmour |
| 6,073,086 | A | 6/2000 | Marinelli |
| 6,083,123 | A | 7/2000 | Wood |
| 6,093,113 | A | 7/2000 | Mertens |
| 6,095,928 | A | 8/2000 | Goszyk |
| 6,224,493 | B1 | 5/2001 | Lee et al. |
| 6,251,028 | B1 | 6/2001 | Jackson |
| 6,302,461 | B1 | 10/2001 | Debras et al. |
| 6,309,310 | B1 | 10/2001 | Shira |
| RE37,647 | E | 4/2002 | Wolf |
| 6,364,787 | B1 | 4/2002 | Huiskamp |
| 6,366,205 | B1 | 4/2002 | Sutphen |
| 6,375,579 | B1 | 4/2002 | Hart |
| 6,386,939 | B1 | 5/2002 | Wu et al. |
| 6,413,167 | B1 | 7/2002 | Burke |
| 6,435,975 | B2 | 8/2002 | Middleton |
| 6,441,745 | B1 | 8/2002 | Gates |
| D463,520 | S | 9/2002 | Ulrich |
| 6,447,405 | B1 | 9/2002 | Chen |
| 6,449,803 | B1 | 9/2002 | McConchie |
| 6,471,601 | B1 | 10/2002 | McCabe et al. |
| 6,488,595 | B1 | 12/2002 | Grace |
| 6,494,790 | B1 | 12/2002 | Toyota et al. |
| 6,506,128 | B1 | 1/2003 | Bloom, Jr. |
| 6,517,352 | B2 | 2/2003 | Smith |
| 6,527,648 | B2 | 3/2003 | Erickson et al. |
| 6,551,198 | B2 | 4/2003 | Huang |
| 6,569,029 | B1 | 5/2003 | Hamburger |
| 6,585,605 | B2 | 7/2003 | Erickson et al. |
| 6,626,768 | B2 | 9/2003 | Roelke |
| 6,656,054 | B2 | 12/2003 | Ulrich |
| 6,666,777 | B1 | 12/2003 | Lamkin et al. |
| 6,709,344 | B2 | 3/2004 | Erickson et al. |
| 6,719,648 | B1 | 4/2004 | Smith |
| D492,374 | S | 6/2004 | Barouh |
| 6,753,778 | B2 | 6/2004 | Kruger |
| 6,793,585 | B1 | 9/2004 | Miyamoto et al. |
| 6,821,211 | B2 | 11/2004 | Otten et al. |
| 6,843,732 | B1 | 1/2005 | Huang |
| 6,857,971 | B2 | 2/2005 | Huang |
| 6,860,818 | B2 | 3/2005 | Mahaffey et al. |
| 6,966,847 | B2 | 11/2005 | Lenhof et al. |
| 6,988,958 | B2 | 1/2006 | Roelke |
| D517,138 | S | 3/2006 | Barouh |
| D517,622 | S | 3/2006 | Barouh |
| 7,048,644 | B2 | 5/2006 | Wang |
| 7,101,287 | B1 | 9/2006 | Wagner |
| 7,104,900 | B1 | 9/2006 | Finley |
| 7,137,904 | B2 | 11/2006 | Huang |
| D534,602 | S | 1/2007 | Norton et al. |
| D534,603 | S | 1/2007 | Norton et al. |
| D534,604 | S | 1/2007 | Norton et al. |
| D534,605 | S | 1/2007 | Norton et al. |
| D534,606 | S | 1/2007 | Norton et al. |
| D534,607 | S | 1/2007 | Norton et al. |
| D534,975 | S | 1/2007 | Norton et al. |
| D536,048 | S | 1/2007 | Chen |
| 7,160,200 | B2 | 1/2007 | Grober |
| D538,540 | S | 3/2007 | Barouh |
| D538,868 | S | 3/2007 | Norton et al. |

(56) References Cited

U.S. PATENT DOCUMENTS

| | | | |
|---|---|---|---|
| D538,869 | S | 3/2007 | Wang et al. |
| 7,228,670 | B2 | 6/2007 | Ollman |
| 7,250,006 | B2 | 7/2007 | McGonigle |
| 7,264,555 | B2 | 9/2007 | Lee et al. |
| 7,264,759 | B2 | 9/2007 | Lamkin |
| 7,267,619 | B1 | 9/2007 | Pettis |
| D553,705 | S | 10/2007 | Barouh |
| D554,724 | S | 11/2007 | Savasky |
| D556,847 | S | 12/2007 | DeVaney |
| 7,310,895 | B2 | 12/2007 | Whittlesey et al. |
| 7,311,612 | B2 | 12/2007 | DeLucia |
| 7,319,203 | B1 | 1/2008 | Briggs et al. |
| D562,923 | S | 2/2008 | DeVaney et al. |
| D562,924 | S | 2/2008 | DeVaney et al. |
| D564,610 | S | 3/2008 | Chen |
| 7,396,296 | B2 | 7/2008 | Evans |
| 7,399,235 | B2 | 7/2008 | Gill et al. |
| 7,406,386 | B2 | 7/2008 | Brett et al. |
| 7,438,646 | B2 | 10/2008 | Huang |
| 7,458,902 | B2 | 12/2008 | Gill |
| 7,458,903 | B2 | 12/2008 | Wang et al. |
| 7,470,199 | B2 | 12/2008 | Huang |
| D584,781 | S | 1/2009 | Chen |
| 7,476,160 | B2 | 1/2009 | Hocknell et al. |
| 7,481,716 | B1 | 1/2009 | Johnson |
| D592,262 | S | 5/2009 | Devaney et al. |
| D592,263 | S | 5/2009 | Devaney et al. |
| D592,264 | S | 5/2009 | Devaney et al. |
| D592,265 | S | 5/2009 | Devaney et al. |
| D592,266 | S | 5/2009 | Devaney et al. |
| D592,267 | S | 5/2009 | Devaney et al. |
| D593,172 | S | 5/2009 | Gill et al. |
| 7,527,564 | B2 | 5/2009 | Huang |
| 7,537,526 | B2 | 5/2009 | Cho |
| D595,378 | S | 6/2009 | Devaney et al. |
| D595,379 | S | 6/2009 | Devaney et al. |
| D595,380 | S | 6/2009 | Koehler |
| D595,796 | S | 7/2009 | Devaney et al. |
| 7,563,174 | B1 | 7/2009 | Hung |
| D597,622 | S | 8/2009 | Devaney et al. |
| 7,585,230 | B2 | 9/2009 | Huang |
| D602,104 | S | 10/2009 | Black et al. |
| D603,921 | S | 11/2009 | Gill et al. |
| 7,641,565 | B2 | 1/2010 | Kiraly |
| 7,648,426 | B2 | 1/2010 | Evans |
| 7,672,781 | B2 | 3/2010 | Churchill et al. |
| 7,699,717 | B2 | 4/2010 | Morris et al. |
| 7,699,718 | B2 | 4/2010 | Lindner |
| 7,704,155 | B2 | 4/2010 | Bennett et al. |
| 7,704,160 | B2 | 4/2010 | Lindner |
| 7,705,733 | B2 | 4/2010 | Tethrake et al. |
| D618,296 | S | 6/2010 | Gill et al. |
| 7,736,242 | B2 | 6/2010 | Stites et al. |
| 7,758,447 | B2 | 7/2010 | Sugimae |
| 7,780,541 | B2 | 8/2010 | Bauer |
| 7,797,783 | B2 | 9/2010 | Chandler et al. |
| 7,798,911 | B2 | 9/2010 | Gill |
| 7,798,912 | B2 | 9/2010 | Kou |
| 7,803,065 | B2 | 9/2010 | Breier et al. |
| 7,804,404 | B1 | 9/2010 | Balardeta et al. |
| D626,614 | S | 11/2010 | Wood et al. |
| D627,023 | S | 11/2010 | Hsu |
| 7,837,574 | B2 | 11/2010 | Brunner |
| 7,837,575 | B2 | 11/2010 | Lee et al. |
| 7,837,577 | B2 | 11/2010 | Evans |
| D629,857 | S | 12/2010 | Gill et al. |
| 7,870,790 | B2 | 1/2011 | Sato et al. |
| 7,878,921 | B2 | 2/2011 | Bennett et al. |
| 7,909,705 | B2 | 3/2011 | Gill et al. |
| 7,927,236 | B2 | 4/2011 | Brunton et al. |
| 7,931,544 | B2 | 4/2011 | Gill |
| 7,934,999 | B2 | 5/2011 | Cackett et al. |
| 7,946,926 | B1 | 5/2011 | Balardeta et al. |
| 7,967,695 | B2 | 6/2011 | Voges et al. |
| D644,285 | S | 8/2011 | Gill et al. |
| 8,006,349 | B2 | 8/2011 | Gill |
| 8,012,034 | B1 | 9/2011 | Cackett et al. |
| D648,816 | S | 11/2011 | Sun |
| D652,097 | S | 1/2012 | Gill |
| D653,296 | S | 1/2012 | Gill |
| 8,105,522 | B2 | 1/2012 | Walls et al. |
| 8,123,627 | B2 | 2/2012 | Huang |
| D656,424 | S | 3/2012 | Bentley |
| 8,142,304 | B2 | 3/2012 | Reeves |
| D657,432 | S | 4/2012 | Gill |
| D657,835 | S | 4/2012 | Gill |
| D660,385 | S | 5/2012 | Gill |
| D660,386 | S | 5/2012 | Chang |
| D660,387 | S | 5/2012 | Sun |
| D660,388 | S | 5/2012 | Gill et al. |
| 8,177,658 | B1 | 5/2012 | Johnson |
| 8,182,361 | B2 | 5/2012 | Gill |
| 8,183,487 | B2 | 5/2012 | Lee |
| D664,223 | S | 7/2012 | Lamkin et al. |
| D664,224 | S | 7/2012 | Lamkin et al. |
| D664,225 | S | 7/2012 | Lamkin et al. |
| 8,226,495 | B2 | 7/2012 | Savarese et al. |
| 8,226,501 | B2 | 7/2012 | Stites et al. |
| 8,253,586 | B1 | 8/2012 | Matak |
| 8,294,066 | B2 | 10/2012 | Gill et al. |
| 8,296,907 | B2 | 10/2012 | Gill et al. |
| 8,296,908 | B2 | 10/2012 | Gill |
| 8,303,429 | B2 | 11/2012 | Cackett et al. |
| 8,303,434 | B1 | 11/2012 | DePaul |
| 8,323,433 | B1 | 12/2012 | Lowry et al. |
| 8,334,337 | B2 | 12/2012 | Lamkin et al. |
| 8,360,898 | B2 | 1/2013 | Huang |
| 8,371,956 | B2 | 2/2013 | Walls |
| 8,371,962 | B2 | 2/2013 | Solheim et al. |
| 8,419,566 | B2 | 4/2013 | Gill |
| 8,424,164 | B2 | 4/2013 | Gill |
| 8,430,764 | B2 | 4/2013 | Bennett et al. |
| 8,465,376 | B2 | 6/2013 | Bentley |
| 8,480,510 | B2 | 7/2013 | Huang |
| 8,485,916 | B2 | 7/2013 | Gill et al. |
| 8,491,409 | B2 | 7/2013 | Turnpaugh et al. |
| 8,496,543 | B2 | 7/2013 | Cackett et al. |
| 8,517,850 | B1 | 8/2013 | Beno et al. |
| 8,517,851 | B2 | 8/2013 | Cackett et al. |
| D689,495 | S | 9/2013 | Bentley et al. |
| 8,541,497 | B2 | 9/2013 | Lamkin et al. |
| D691,682 | S | 10/2013 | Su et al. |
| D693,892 | S | 11/2013 | Bentley et al. |
| 8,579,731 | B2 | 11/2013 | Gadiyar et al. |
| 8,591,350 | B2 | 11/2013 | Evans et al. |
| D694,842 | S | 12/2013 | Bentley et al. |
| 8,613,676 | B2 | 12/2013 | Bentley |
| 8,617,005 | B2 | 12/2013 | Moran et al. |
| 8,624,738 | B2 | 1/2014 | Savarese et al. |
| 8,641,551 | B2 | 2/2014 | Johnson |
| 8,641,553 | B2 | 2/2014 | Gill et al. |
| 8,647,462 | B2 | 2/2014 | Su et al. |
| 8,700,354 | B1 | 4/2014 | Bentley et al. |
| 8,702,516 | B2 | 4/2014 | Bentley et al. |
| 8,715,096 | B2 | 5/2014 | Cherbini |
| 8,734,267 | B2 | 5/2014 | Huang |
| D706,654 | S | 6/2014 | Bentley et al. |
| 8,766,088 | B2 | 7/2014 | Cheng et al. |
| D710,466 | S | 8/2014 | Bentley et al. |
| 8,804,404 | B2 | 8/2014 | Asami et al. |
| 8,814,718 | B1 | 8/2014 | Rollinson et al. |
| 8,814,719 | B2 | 8/2014 | Wall, Jr. |
| 8,827,824 | B2 | 9/2014 | Bentley et al. |
| 8,840,483 | B1 | 9/2014 | Steusloff et al. |
| 8,845,448 | B2 | 9/2014 | Huang |
| 8,858,356 | B2 | 10/2014 | Chu et al. |
| 8,870,673 | B2 | 10/2014 | Beno et al. |
| 8,888,606 | B2 | 11/2014 | Boccieri |
| 8,903,521 | B2 | 12/2014 | Goree et al. |
| 8,905,855 | B2 | 12/2014 | Fitzpatrick et al. |
| 8,913,134 | B2 | 12/2014 | Goree et al. |
| 8,932,146 | B2 | 1/2015 | Chu et al. |
| 8,941,723 | B2 | 1/2015 | Bentley et al. |
| 8,944,928 | B2 | 2/2015 | Kaps et al. |

(56) References Cited

U.S. PATENT DOCUMENTS 8,992,346 B1 3/2015 Raposo
8,994,826 B2 3/2015 Bentley
9,005,047 B2 4/2015 Savarese et al.
9,028,337 B2 5/2015 Bentley
9,033,810 B2 5/2015 Bentley
9,039,527 B2 5/2015 Bentley et al.
9,052,201 B2 6/2015 Bentley et al.
9,072,952 B2 7/2015 Chu et al.
9,076,041 B2 7/2015 Bentley et al.
D735,825 S 8/2015 Lamkin et al.
9,114,295 B2 8/2015 Huang
D738,973 S 9/2015 Dingman
D738,974 S 9/2015 Miller et al.
9,174,104 B1 11/2015 Rogacki
9,192,833 B2 11/2015 Margoles et al.
9,195,781 B2 11/2015 Savarese et al.
D745,100 S 12/2015 Miller et al.
9,199,146 B2 12/2015 Lamkin et al.
9,211,456 B2 12/2015 Barksdale et al.
9,227,118 B2 1/2016 Beno et al.
9,235,765 B2 1/2016 Bentley et al.
9,247,212 B2 1/2016 Bose et al.
9,261,526 B2 2/2016 Bentley et al.
9,302,164 B2 4/2016 Lamkin et al.
9,320,957 B2 4/2016 Bentley
9,349,049 B2 5/2016 Bentley et al.
9,361,522 B2 6/2016 Bentley et al.
9,375,833 B2 6/2016 Huang
9,396,385 B2 7/2016 Bentley et al.
9,401,178 B2 7/2016 Bentley et al.
9,403,073 B2 8/2016 McDonnell et al.
9,406,336 B2 8/2016 Bose et al.
9,409,071 B1 8/2016 Beno et al.
9,418,705 B2 8/2016 Kaps et al.
9,421,421 B2 8/2016 Knutson et al.
9,421,439 B2 8/2016 McLoughlin
D768,251 S 10/2016 Giannatti et al.
D772,361 S 11/2016 Giannatti et al.
9,568,108 B2 2/2017 Takahashi
9,604,142 B2 3/2017 Bentley et al.
9,607,652 B2 3/2017 Bose et al.
9,616,298 B1 4/2017 Barksdale et al.
9,619,891 B2 4/2017 Bose et al.
9,622,361 B2 4/2017 Bentley et al.
9,626,554 B2 4/2017 Bose et al.
9,633,254 B2 4/2017 Bose et al.
9,643,049 B2 5/2017 Bentley et al.
9,646,199 B2 5/2017 Bose et al.
9,646,209 B2 5/2017 Kaps et al.
9,694,267 B1 7/2017 Thornbrue et al.
9,746,354 B2 8/2017 Martin et al.
D796,609 S 9/2017 Serrano et al.
9,791,253 B2 10/2017 Rothenbuhler et al.
9,814,935 B2 11/2017 Bentley et al.
9,824,264 B2 11/2017 Bose et al.
9,830,951 B2 11/2017 Bose et al.
D807,215 S 1/2018 Martin et al.
9,866,827 B2 1/2018 Bose et al.
9,911,045 B2 3/2018 Bose et al.
2002/0077189 A1 6/2002 Tuer et al.
2002/0187860 A1 12/2002 Shoane
2003/0008731 A1 1/2003 Anderson et al.
2003/0104876 A1 6/2003 Sosin
2003/0144088 A1 7/2003 Shoane
2003/0157990 A1 8/2003 Bloom
2003/0176234 A1 9/2003 Sheets et al.
2004/0087384 A1 5/2004 Sosin
2004/0147339 A1 7/2004 Lindner et al.
2004/0166958 A1 8/2004 Perry
2004/0219987 A1 11/2004 Scott et al.
2004/0224787 A1 11/2004 Lindner
2005/0079925 A1 4/2005 Cheng et al.
2005/0215347 A1 9/2005 Pollman
2005/0272516 A1 12/2005 Gobush
2005/0288119 A1 12/2005 Wang et al.
2006/0094527 A1 5/2006 Evans
2006/0128489 A1 6/2006 Mooney et al.
2006/0166737 A1 7/2006 Bentley
2006/0166738 A1 7/2006 Eyestone et al.
2006/0199659 A1 9/2006 Caldwell
2006/0255918 A1 11/2006 Bernstein et al.
2006/0261938 A1 11/2006 Lai et al.
2007/0004529 A1* 1/2007 Huang ..... A63B 60/00 473/300
2007/0049397 A1 3/2007 Bieske
2007/0072696 A1 3/2007 Chen
2007/0149310 A1 6/2007 Bennett et al.
2007/0149315 A1 6/2007 Bennett et al.
2007/0159336 A1 7/2007 Tethrake et al.
2007/0161431 A1 7/2007 Lindner
2007/0191126 A1 8/2007 Mandracken
2007/0270214 A1 11/2007 Bentley
2007/0298895 A1 12/2007 Nusbaum et al.
2007/0298896 A1 12/2007 Nusbaum et al.
2008/0009363 A1 1/2008 Solodovnick
2008/0020861 A1 1/2008 Adams et al.
2008/0125239 A1 5/2008 Clausen et al.
2008/0132350 A1 6/2008 Gill et al.
2008/0148050 A1 6/2008 Sparrell
2008/0198022 A1 8/2008 Battles et al.
2008/0227562 A1 9/2008 Gill
2008/0227564 A1 9/2008 Breier et al.
2008/0254909 A1 10/2008 Callinan et al.
2008/0274822 A1 11/2008 Lindner
2008/0274823 A1 11/2008 Lindner
2009/0017935 A1 1/2009 Wang et al.
2009/0017944 A1 1/2009 Savarese et al.
2009/0075747 A1 3/2009 Kou
2009/0088275 A1 4/2009 Solheim et al.
2009/0111602 A1 4/2009 Savarese et al.
2009/0124410 A1 5/2009 Rife
2009/0131190 A1 5/2009 Kimber
2009/0143882 A1 6/2009 Young
2009/0197694 A1 8/2009 Soracco et al.
2009/0209358 A1 8/2009 Niegowski
2009/0215551 A1 8/2009 Liang et al.
2009/0233730 A1 9/2009 Doerr
2009/0233735 A1 9/2009 Savarese et al.
2009/0239673 A1 9/2009 Drimer
2009/0247312 A1 10/2009 Sato et al.
2009/0247316 A1 10/2009 De La Cruz et al.
2009/0253528 A1 10/2009 Brolly
2009/0264214 A1 10/2009 De La Cruz et al.
2009/0298605 A1 12/2009 Wiegers
2009/0326688 A1 12/2009 Thomas et al.
2010/0056297 A1 3/2010 Roach et al.
2010/0081515 A1 4/2010 White et al.
2010/0093457 A1 4/2010 Ahern et al.
2010/0093458 A1 4/2010 Davenport et al.
2010/0093463 A1 4/2010 Davenport et al.
2010/0105498 A1 4/2010 Johnson
2010/0105499 A1 4/2010 Roach et al.
2010/0113174 A1 5/2010 Ahern
2010/0144455 A1 6/2010 Ahern
2010/0144456 A1 6/2010 Ahern
2010/0154255 A1 6/2010 Robinson et al.
2010/0210377 A1 8/2010 Lock
2010/0222152 A1 9/2010 Jaekel et al.
2010/0261543 A1 10/2010 Breier et al.
2010/0287735 A1 11/2010 Gill et al.
2010/0292018 A1 11/2010 Cackett et al.
2010/0298065 A1 11/2010 Soracco et al.
2010/0304877 A1 12/2010 Iwahashi et al.
2010/0308105 A1 12/2010 Savarese et al.
2010/0323811 A1 12/2010 Mickelson et al.
2011/0028230 A1 2/2011 Balardeta et al.
2011/0039637 A1 2/2011 Cackett et al.
2011/0053702 A1 3/2011 Stites et al.
2011/0053703 A1 3/2011 Stites et al.
2011/0143854 A1 6/2011 Bennett et al.
2011/0151989 A1 6/2011 Golden et al.
2011/0152003 A1 6/2011 Hartwell et al.
2011/0159982 A1 6/2011 Takeuchi
2011/0165959 A1 7/2011 Klein

(56) References Cited

U.S. PATENT DOCUMENTS

2011/0190070 A1 8/2011 Morris et al.
2011/0207560 A1 8/2011 Wright et al.
2011/0257945 A1 10/2011 Sato
2011/0275455 A1 11/2011 Soracco
2011/0277313 A1 11/2011 Soracco et al.
2011/0304460 A1 12/2011 Keecheril et al.
2011/0305369 A1 12/2011 Bentley et al.
2011/0312436 A1 12/2011 Cackett et al.
2012/0035003 A1 2/2012 Moran et al.
2012/0050529 A1 3/2012 Bentley
2012/0052971 A1 3/2012 Bentley
2012/0052972 A1 3/2012 Bentley
2012/0052973 A1 3/2012 Bentley
2012/0071258 A1 3/2012 Yamaguchi et al.
2012/0116548 A1 5/2012 Goree et al.
2012/0120572 A1 5/2012 Bentley
2012/0120573 A1 5/2012 Bentley
2012/0122574 A1 5/2012 Fitzpatrick et al.
2012/0122603 A1 5/2012 Cackett et al.
2012/0139729 A1 6/2012 Savarese et al.
2012/0196692 A1 8/2012 Beck et al.
2012/0202610 A1 8/2012 Voges et al.
2012/0215474 A1 8/2012 Bentley et al.
2012/0238381 A1 9/2012 Denton et al.
2012/0249330 A1 10/2012 Savarese et al.
2012/0256731 A1 10/2012 Luciano, Jr. et al.
2012/0276851 A1 11/2012 Layne, IV et al.
2012/0277015 A1 11/2012 Boyd et al.
2012/0277018 A1 11/2012 Boyd et al.
2012/0295726 A1 11/2012 Cherbini
2012/0316843 A1 12/2012 Beno et al.
2012/0322569 A1 12/2012 Cottam
2012/0331058 A1 12/2012 Huston et al.
2013/0012334 A1 1/2013 Stites et al.
2013/0027602 A1 1/2013 Kasuga
2013/0029783 A1 1/2013 Kimizuka et al.
2013/0063432 A1 3/2013 Kaps et al.
2013/0065703 A1 3/2013 Rose
2013/0095941 A1 4/2013 Bentley et al.
2013/0128022 A1 5/2013 Bose et al.
2013/0144411 A1 6/2013 Savarese et al.
2013/0165249 A1 6/2013 Margoles et al.
2013/0203517 A1 8/2013 Bolane et al.
2013/0211774 A1 8/2013 Bentley et al.
2013/0225309 A1 8/2013 Bentley et al.
2013/0225317 A1 8/2013 Clausen et al.
2014/0014953 A1 1/2014 Asami et al.
2014/0162802 A1 6/2014 Beno et al.
2014/0221121 A1 8/2014 Margoles et al.
2014/0229138 A1 8/2014 Goree et al.
2014/0342845 A1 11/2014 Dingman
2014/0376876 A1 12/2014 Bentley et al.
2015/0011324 A1 1/2015 Beno et al.
2015/0018890 A1 1/2015 Ihde
2015/0034859 A1 2/2015 Compton et al.
2015/0105175 A1 4/2015 Wang
2015/0154452 A1 6/2015 Bentley et al.
2015/0231462 A1 8/2015 Chapin
2015/0251063 A1 9/2015 Dingman et al.
2015/0251064 A1* 9/2015 Chapin ..... A63B 53/14 473/297
2015/0269435 A1 9/2015 Bentley et al.
2015/0310280 A1 10/2015 Bentley et al.
2015/0317801 A1 11/2015 Bentley et al.
2015/0318015 A1 11/2015 Bose et al.
2015/0324636 A1 11/2015 Bentley et al.
2015/0348591 A1 12/2015 Kaps et al.
2015/0360101 A1 12/2015 Solhaug
2015/0367211 A1* 12/2015 Lyons ..... A63B 60/14 473/549
2016/0089085 A1* 3/2016 Oguchi ..... A63B 69/3632 73/12.04
2016/0089584 A1 3/2016 Beno et al.
2016/0146643 A1 5/2016 Martin et al.
2016/0151666 A1 6/2016 Bentley et al.
2016/0166903 A1 6/2016 McDonnell et al.
2016/0184639 A1 6/2016 Bentley et al.
2016/0210549 A1 7/2016 Savarese et al.
2016/0213987 A1 7/2016 Beno et al.
2016/0217325 A1 7/2016 Bose et al.
2016/0224828 A1 8/2016 Bose et al.
2016/0292509 A1 10/2016 Kaps et al.
2016/0292881 A1 10/2016 Bose et al.
2016/0322078 A1 11/2016 Bose et al.
2016/0346657 A1 12/2016 Beno et al.
2016/0354634 A1 12/2016 McDonnell et al.
2017/0004358 A1 1/2017 Bose et al.
2017/0165543 A1* 6/2017 Breeden, III ..... A63B 53/14
2017/0220855 A1 8/2017 Bose et al.
2017/0229154 A1 8/2017 Bose et al.
2017/0230651 A1 8/2017 Bose et al.
2017/0234706 A1* 8/2017 Martin ..... G01D 11/245 29/407.05
2017/0243359 A1 8/2017 Bose et al.
2017/0252607 A1 9/2017 Haas et al.
2017/0262697 A1 9/2017 Kaps et al.
2017/0296868 A1 10/2017 Bentley et al.
2017/0300755 A1 10/2017 Bose et al.
2018/0021648 A1 1/2018 Thornbrue et al.
2018/0021653 A1 1/2018 Thornbrue et al.

FOREIGN PATENT DOCUMENTS

WO WO-2014/153097 A1 9/2014
WO WO-2017/095936 A1 6/2017

* cited by examiner

GOLF CLUB GRIP WITH SENSOR HOUSING

FIELD

The present disclosure relates to a grip for a golf club, and more particularly, to a grip having a sensor housing.

BACKGROUND

This section provides background information related to the present disclosure and is not necessarily prior art.

In addition to the refinement of a golfer's swing, knowing the swing path and swing parameters can help a golfer make adjustments and become more consistent. Sensors have been attached to various implements for measuring movement. Encouraging use of a sensor during practice is important. However, many means of providing a sensor on a sporting good are cumbersome to use and are thus less likely to be used.

SUMMARY

It may be advantageous for a golfer to conveniently use a sensor when practicing.

In one aspect of the disclosure, a golf club grip for a golf club comprises an elongated member having a first end, a second end, an inner surface and an outer surface. The first end is configured to receive a golf club shaft. The second end includes a recessed opening. The recessed opening extends away from the second end longitudinally toward the first end. A sensor housing comprising a first portion and a second portion. The first portion is received within the recessed opening. The first portion couples the sensor housing to the elongated member. The second portion receives a removable housing therein.

In another aspect of the disclosure, a golf club grip for a golf club comprises an underlisting having a first end, a second end, an inner surface and an outer surface. The first end is configured to receive a golf club shaft. The second end includes a recessed opening. The recessed opening extends longitudinally toward the first end. A sensor housing is partially received and secured to the underlisting within the recessed opening. The sensor housing and the second end of the underlisting defines a channel therebetween. A gripping layer is disposed around the underlisting. The gripping layer comprises a first edge adjacent the first end and a second edge disposed within the channel. The removable housing is received within the sensor housing.

Further areas of applicability will become apparent from the description provided herein. It should be understood that the description and specific examples are intended for purposes of illustration only and are not intended to limit the scope of the present disclosure.

DRAWINGS

The drawings described herein are for illustrative purposes only of selected examples and not all possible implementations, and are not intended to limit the scope of the present disclosure.

Corresponding reference numerals indicate corresponding parts throughout the several views of the drawings.

DETAILED DESCRIPTION

Figure 1:
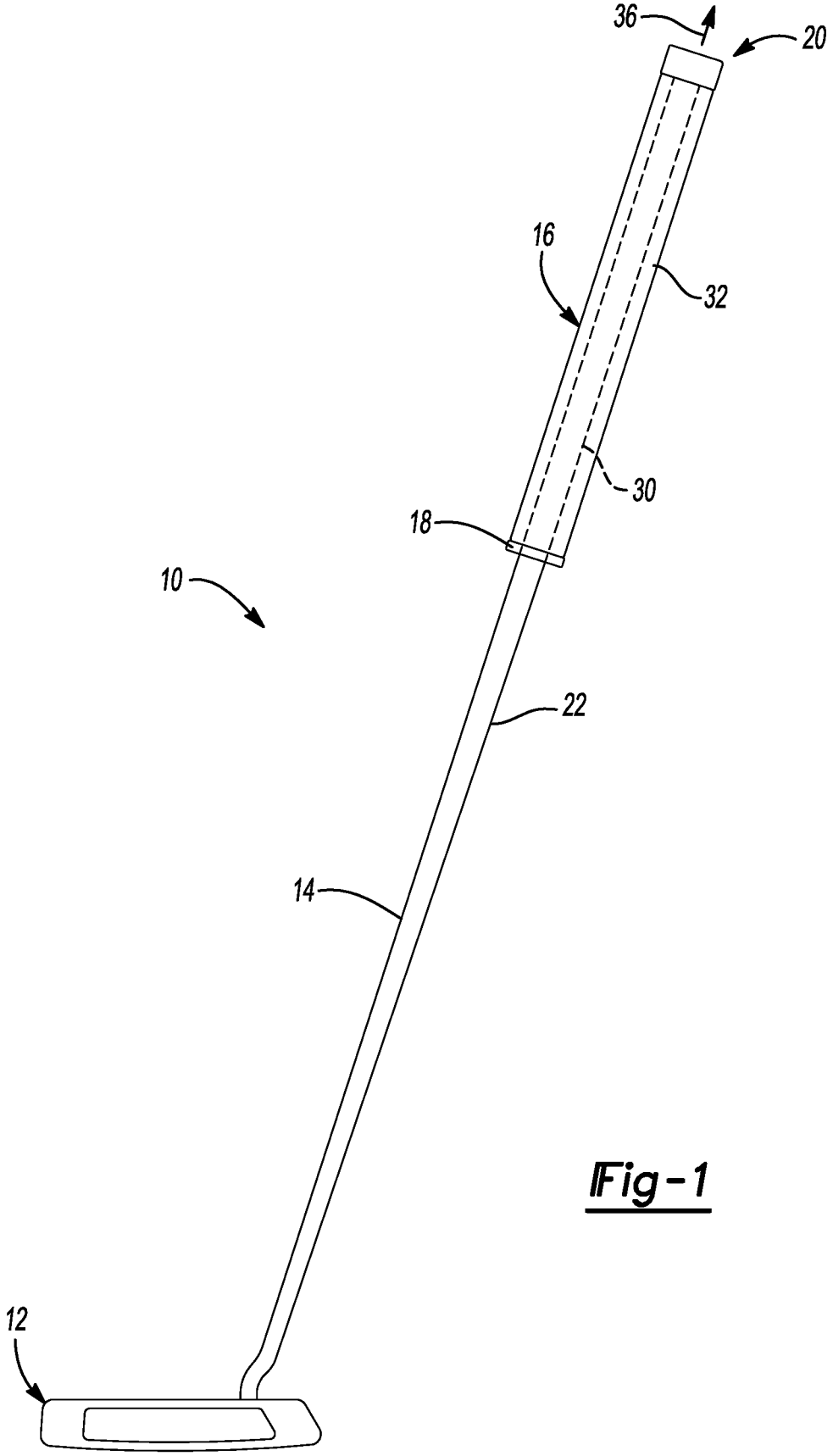
FIG. 1 is a front view of an exemplary golf club including the grip.
Figure 2:
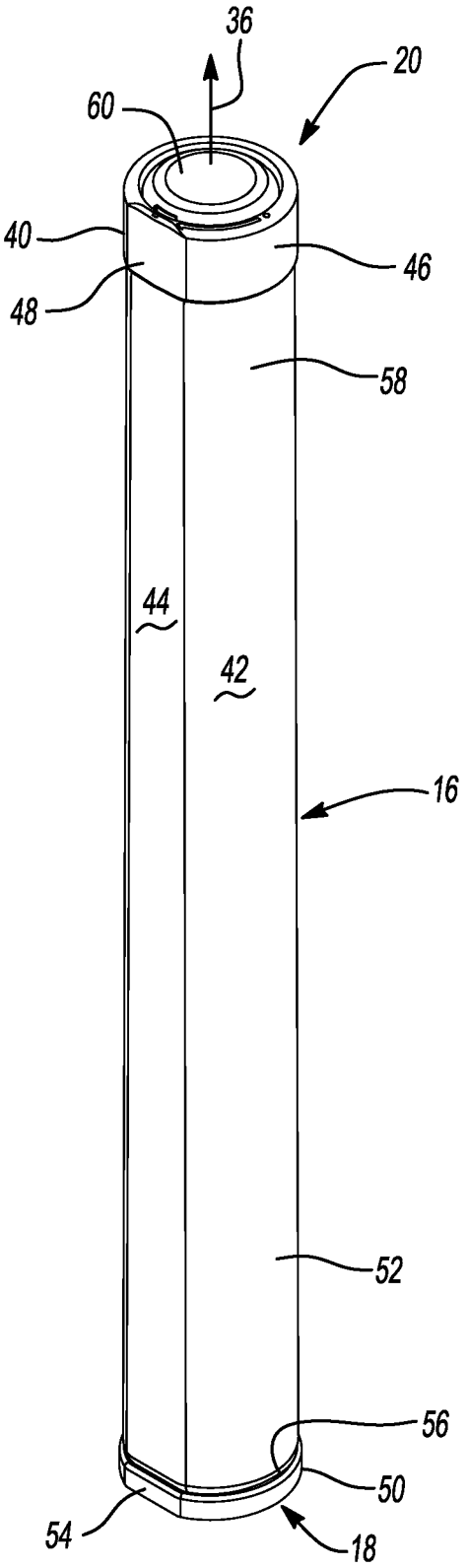
FIG. 2 is a perspective view of the grip assembly according to the present disclosure.
Figure 3:
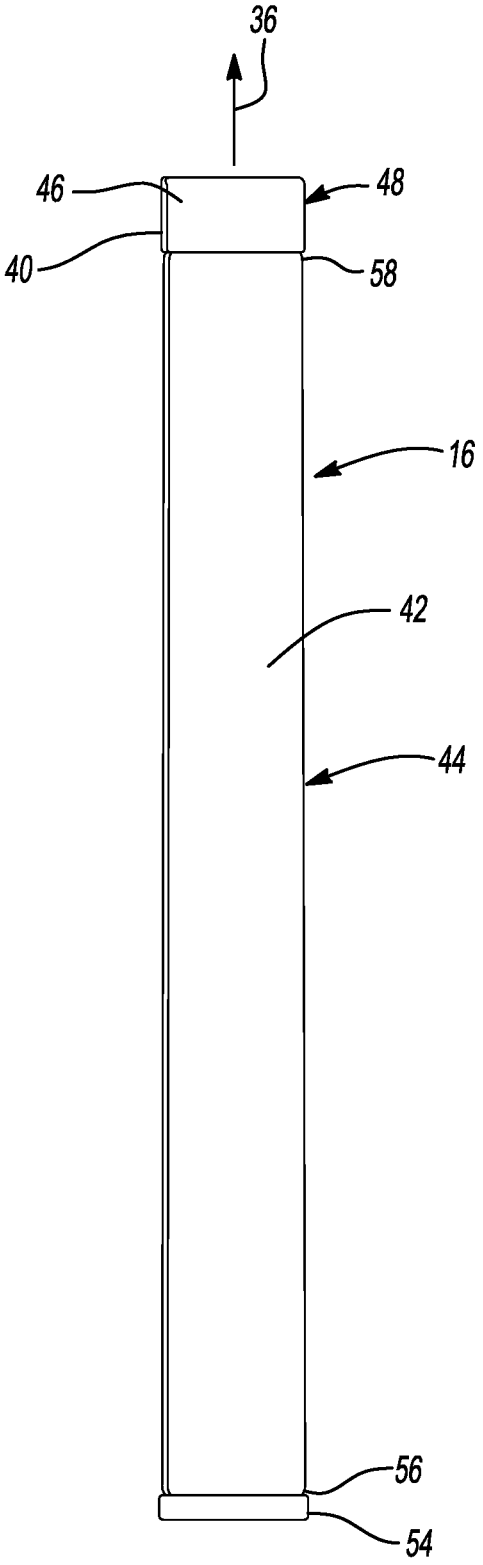
FIG. 3 is a left side view of the grip of FIG. 2.
Figure 4:
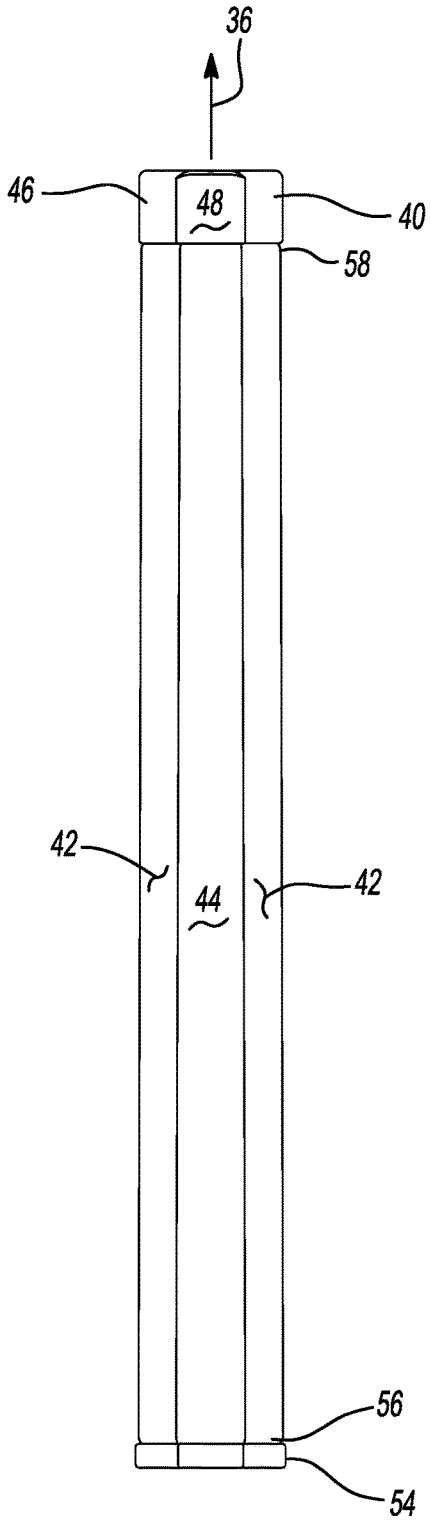
FIG. 4 is a front side view of the grip of FIG. 2.
Figure 5:
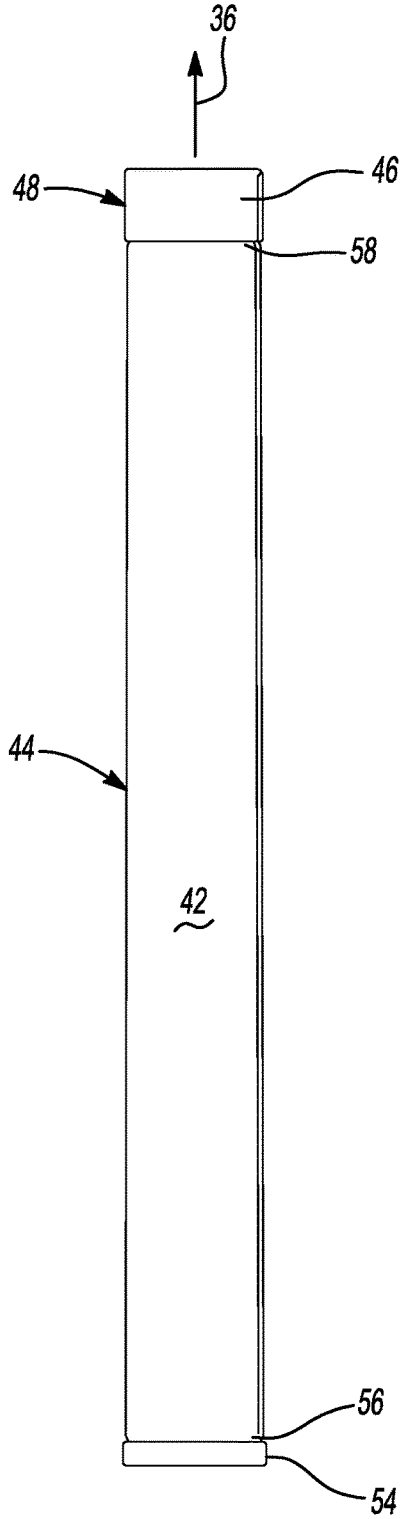
FIG. 5 is a right side view of the grip of FIG. 2.
Figure 6:
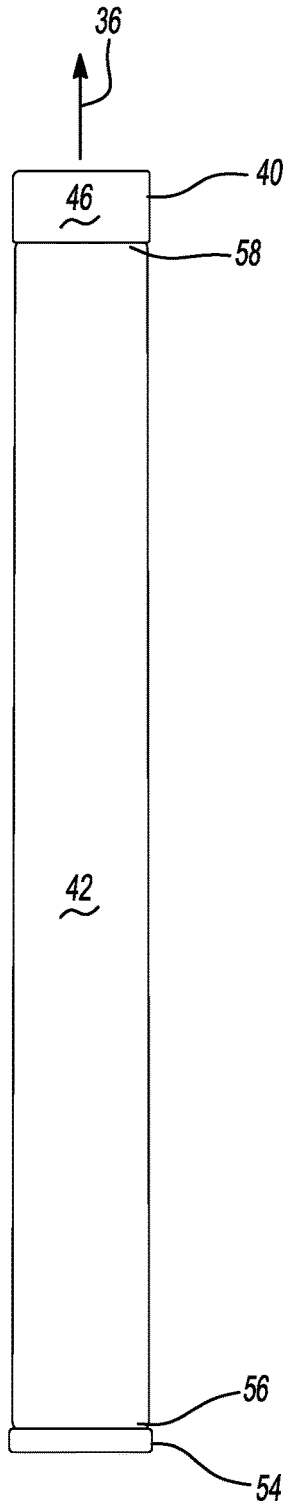
FIG. 6 is a back side view of the grip of FIG. 2.
Figure 7:
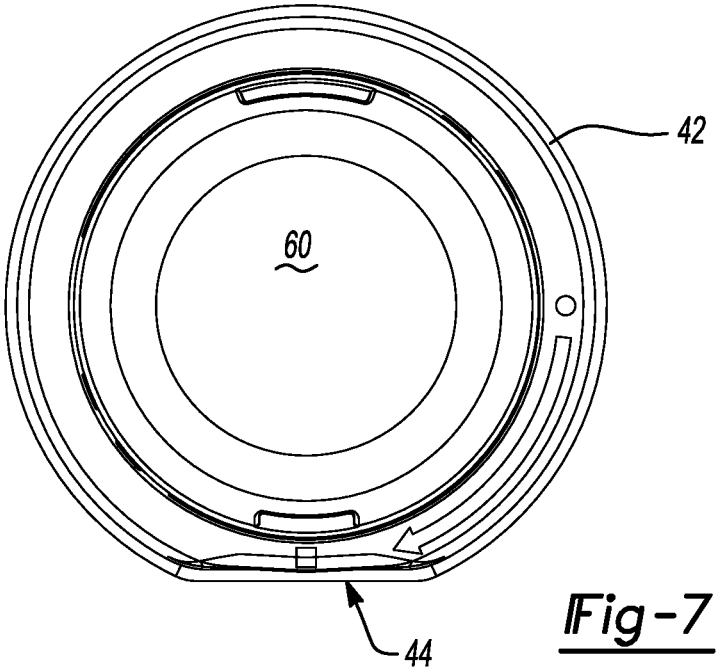
FIG. 7 is a top side view of the grip of FIG. 2.

The following description is merely exemplary in nature and is not intended to limit the present disclosure, application, or uses. For purposes of clarity, the same reference numbers will be used in the drawings to identify similar elements. Examples are provided so that this description will be thorough, and will fully convey the scope to those who are skilled in the art. Numerous specific details are set forth, such as examples of specific components, to provide a thorough understanding of examples of the present disclosure. It will be apparent to those skilled in the art that specific details need not be employed, that examples may be embodied in many different forms, and that neither should be construed to limit the scope of the description. Moreover, it should be understood that the teachings of the present disclosure may be applied to other applications where it may be advantageous and/or desirable to adjust the weight of a device. For example, such applications may include, but are not limited to: a tennis racquet, a fishing pole, and/or a hockey stick.

With reference to FIG. 1, a golf club 10 including a head 12, a shaft 14, and a grip 16 is shown. The head 12 may be configured to hit a golf ball (not shown) from various locations on a golf course. For example, the head 12 may be configured to hit a golf ball from a putting green (i.e., a putter, as shown), from a tee box (i.e., a driver), or from a fairway, rough, or bunker (i.e., an iron or wedge).

The grip 16 is disposed at the end of the shaft 14 opposite the head 12. The grip 16 includes a first end 18, and a second end 20. The first end 18 is closest to the head 12.

The shaft 14 may be fabricated from a suitable material, such as metal (i.e., a steel shaft) or carbon fiber (i.e., a graphite shaft). The shaft 14 is secured to head 12. The shaft 14 may maintain a uniform cross-section, or the cross-section may taper. Accordingly, the shaft 14 includes an outer surface 22.

The grip 16 is an elongated and hollow member that may be fabricated from a suitable material or materials, such as a natural or synthetic rubber or elastomeric material. The second end 20 may be referred to as a butt end. The first end 28 of the grip 16 may include a first opening configured to receive the shaft 14 into the inner grip cavity 30. The shaft 14 may be received in the inner grip cavity 30 such that the outer surface 22 at the first end 18 the shaft 14 is adjacent the inner surface of the grip 16. The shape of the inner grip cavity 30 may correspond to the shape of the outer surface 22 of the shaft 14. An adhesive or bonding agent may be applied between the inner grip cavity 30 and the outer surface 22 of the shaft 14 to restrict the grip 16 from slipping laterally and/or rotating axially relative to the shaft 14. The outer grip surface 32 may include any shape, such as a cylindrical, pentagonal, hexagonal, or ovoid shape, for example.

The grip 16 and the shaft 14 have a common longitudinal axis 36.

Referring now also to FIGS. 2-7, the grip 16 is coupled to a sensor housing 40. In this example, the grip 16 is generally cylindrical in shape and has a first side 42 and a flat side 44. The sensor housing 40 may also have first side 46 and a flat side 48. The grip 16 has an underlisting 50 over which a gripping layer 52 is disposed. The inner surface of the gripping layer 52 may be disposed on the outer surface of the underlisting 50. An outer surface 53 of the gripping layer 52 may be smooth or textured to provide adequate grip during use of the golf club. In this example, the overall cross-section of the underlisting 50 on the gripping layer 52 corresponds to a cross-section of the sensor housing 40. The underlisting 50 may also have a flange 54 at the bottom thereof. That is, the flange 54 is disposed at the first end 18 of the grip 16.

The gripping layer 52 has a first end 56 and a second end 58. The gripping layer 52 may be a thin material that is different from the material of the underlisting. An example of suitable gripping layers is polyurethane or a combination of polyurethane and felt. Of course, other materials may be sued.

A removable housing 60 may be securely fitted within the sensor housing 40. The removable housing 60 may be used for many purposes including monitoring the swing of a golfer. The removable housing 60 may include a sensor but may also be a blank housing with no sensor therein. In this situation, the removable housing 60 may be used for regular play. Under the rules of golf, using a sensor within a golf club may be prohibited during play.

The sensor housing 40 may be formed of various materials including nylon filled ABS or thermoplastic urethane. The removable housing 60 may also be made of a similar material.

Figure 8:
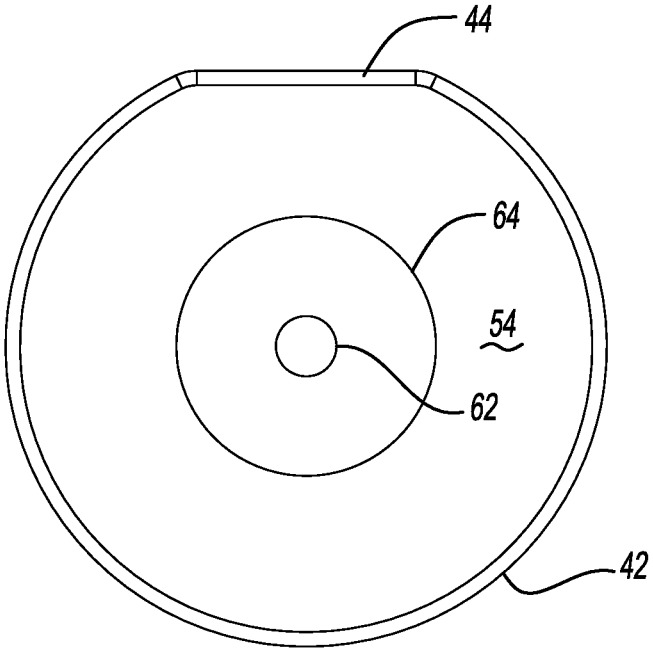
FIG. 8 is a bottom side view of the grip of FIG. 2.

Referring specifically to FIG. 8, the view from the first end 18 of the grip 16 is illustrated. In this example, a shaft opening 62 is used to receive the golf club shaft. An opening 64 in the sensor housing is also illustrated in this example.

Figure 9:
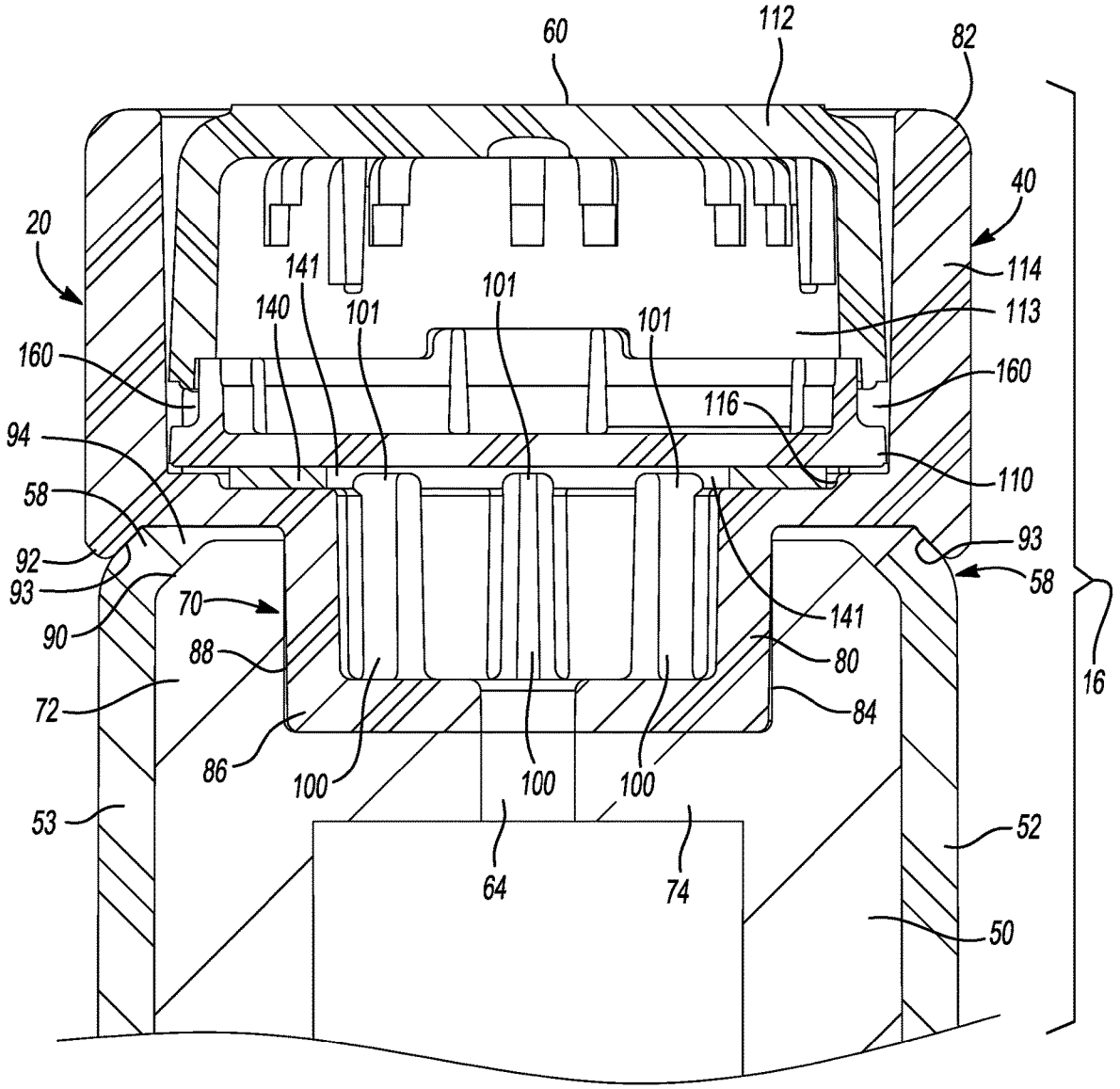
FIG. 9 is a cross-sectional view of the second end of the grip assembly.

Referring now to FIG. 9, a cross-sectional view of the first end 20 of the grip 16 is illustrated in further detail. The underlisting 50 has a recessed opening 70 that is defined by a first wall 72 and a second wall 74. The first wall 72 extends in a longitudinal direction and defines the outer boundary of the recessed opening 70. The wall 72 may be shaped on the inner surface in various shapes. The second wall 74 extends in a radial direction from the first wall 72. The second wall 74 may have the opening 64 therethrough.

The sensor housing 40 includes a first portion 80 and a second portion 82. The first portion 80 is sized to fit within the recessed opening 70. The first portion 80 may include a first wall 84 that extends in a longitudinal direction relative to the golf club and golf club shaft. The first portion 80 may also be coaxial with the underlisting 50. The first wall 84 may be sized to correspond directly to the inner shape of the wall 72. A second wall 86 extends radially from the first wall 84 of the first portion 80 of the sensor housing 40. The second wall 86 may abut directly against the second wall 74 of the recessed opening 70. An adhesive 88 may be disposed between the first wall 72 and the first wall 84 as well as between the second wall 74 and the second wall 86.

The underlisting 50 includes a chamfer 90 that is spaced apart from a lip 92 that longitudinally extends from a bottom surface of the second portion 82 of the sensor housing 40. The upper edge 182 illustrated in FIG. 34 at the second end 58 of the gripping layer 52 is received within a channel 94 between the chamfer 90 and a lip 92. The lip 92 may extend in a longitudinally extending direction toward the first end 18 of the grip 16 from the bottom surface of the second portion 82. The shape of the lip 92, on the inner surface 93, may be parallel to the chamfer 90. By providing the upper edge 182 and the upper end 58 of the gripping layer 52 within the channel 94, a clean finish surface is formed. That is, the upper end 58 cannot be seen. Ribs 100 may be provided within the first portion 80 of the sensor housing 40. The ribs 100 have an upper surface 101 and may extend to be on or nearly on-plane with the second wall 116.

The removable housing 60 may be comprised of a sensor or be empty as illustrated in FIG. 9. The removable housing 60 is formed of a first portion 110 and a second portion 112. The first portion 110 and the second portion 112 define a cavity 113 therein. The first portion 110 and the second portion 112 may be snapped together or glued together. The formation of the removable housing 60 will be described in further detail below.

A first wall 114 of the second portion 82 extends in a longitudinal direction. As is illustrated, the diameter of the first wall 114 is slightly larger than the diameter of the underlisting 50 and the outer surface 53 of the gripping layer 52. A second wall 116 extends radially inwardly from the first wall 114. The second wall 116 is adjacent to the first portion 110 of the removable housing 60. A washer 140 may be disposed within the sensor housing 40 between the recessed housing 60 and the second wall 116.

The washer 140 may be received in a washer channel 141 formed in the second wall 116.

Figure 10:
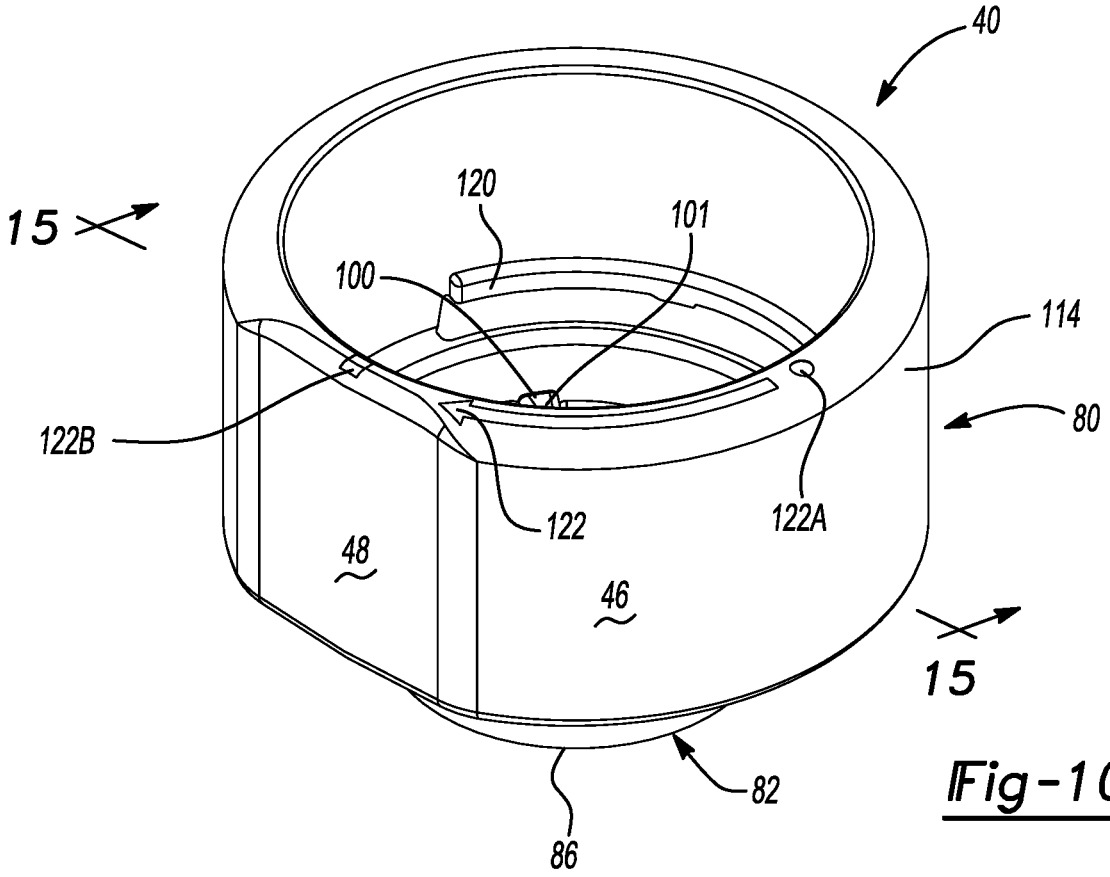
FIG. 10 is a perspective view of the sensor housing.
Figure 16:
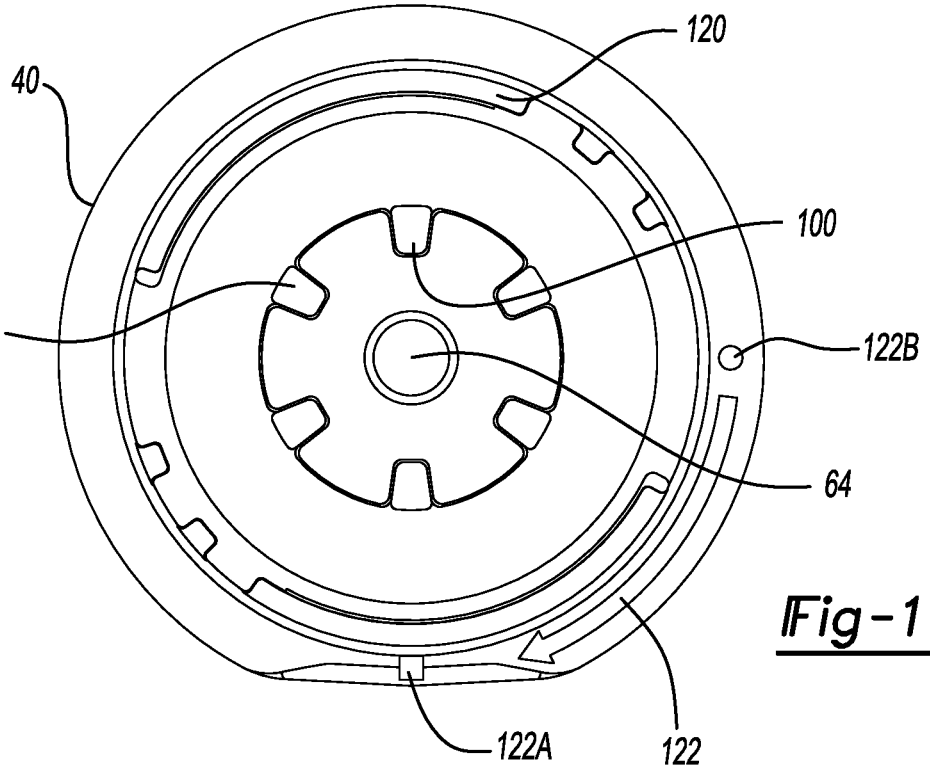
FIG. 16 is a top view of the sensor housing.
Figure 17:
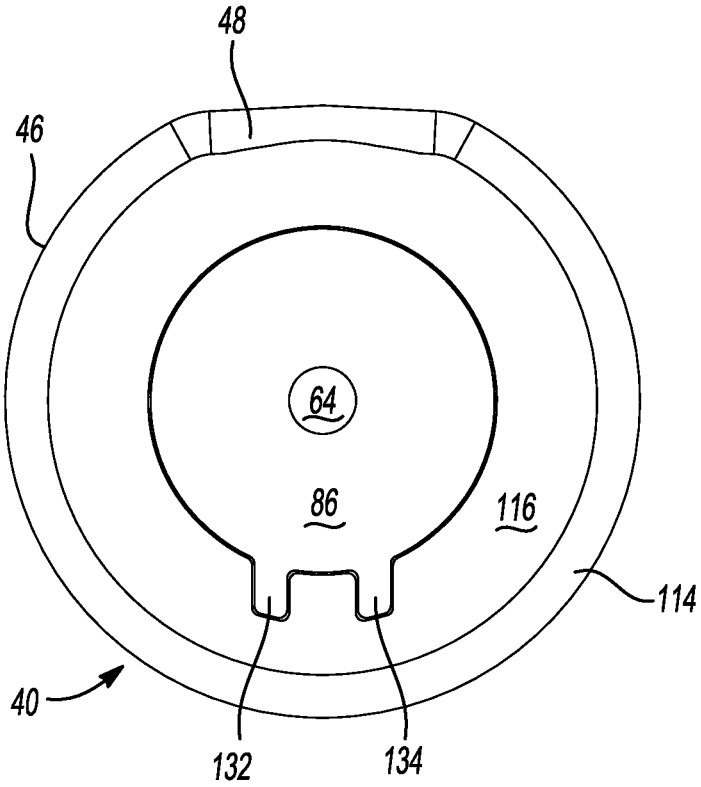
FIG. 17 is a bottom view of the sensor housing.

Referring now to FIGS. 10-17, the sensor housing 40 is illustrated in further detail. In FIG. 10, an engagement surface 120 is used for engaging the removable housing 60 with the sensor housing 40. The engagement surface 120 may be a pair of engagement surfaces 120. This is best illustrated in FIG. 16 which is a top view of the sensor housing 40. The removable housing 60 may be hand related or tool assisted to engage the removable housing 60.

Figure 11:
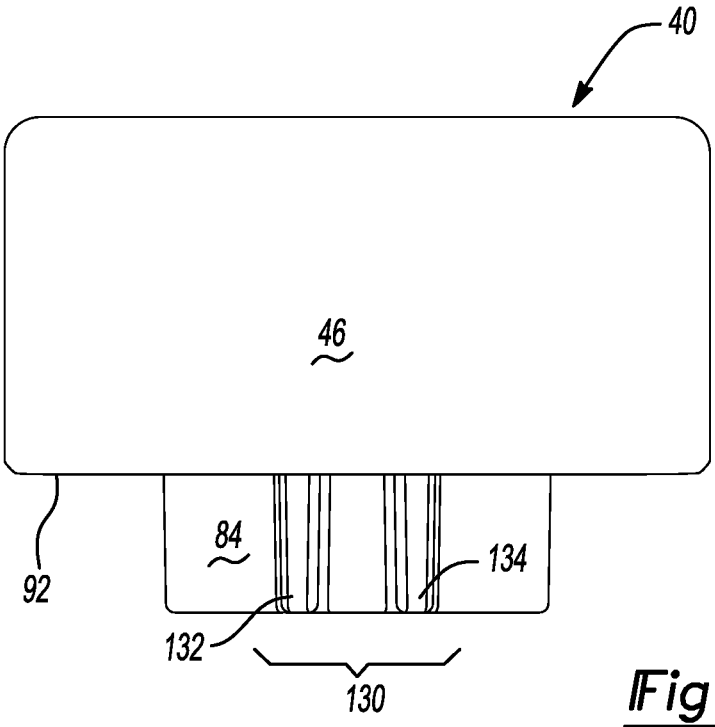
FIG. 11 is a back elevational view of the sensor housing.
Figure 12:
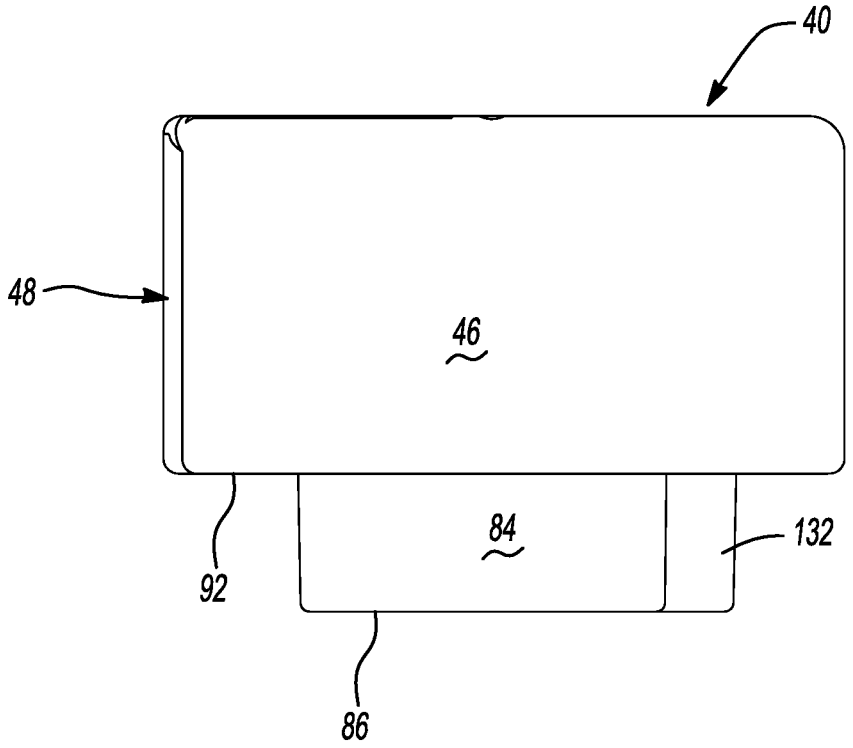
FIG. 12 is a right side view of the sensor housing.
Figure 13:
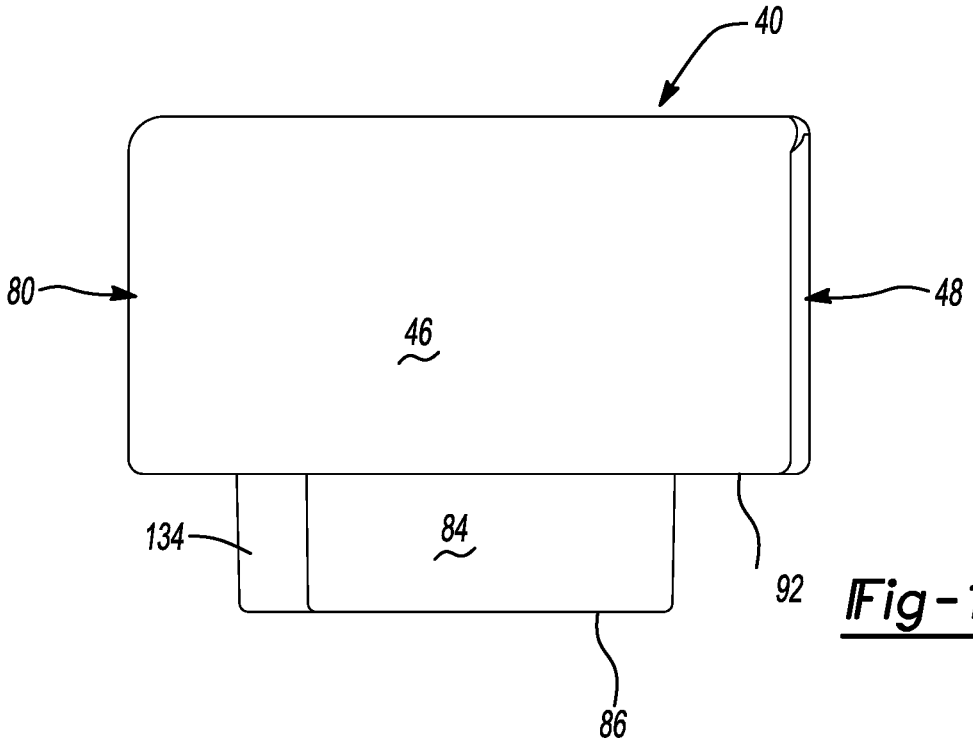
FIG. 13 is a left side view of the sensor housing.
Figure 14:
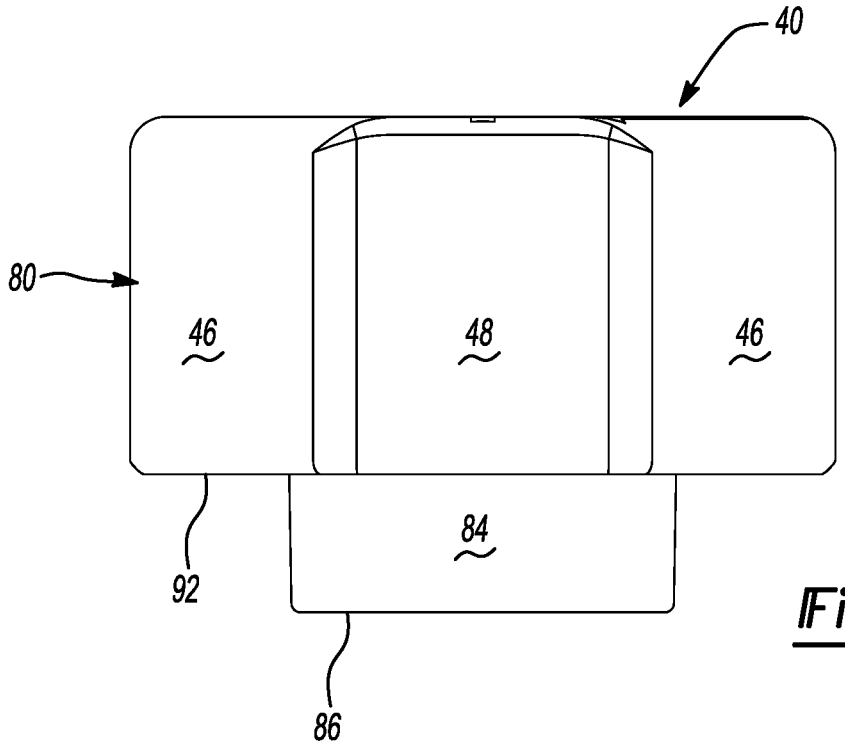
FIG. 14 is a front side view of the sensor housing.
Figure 15:
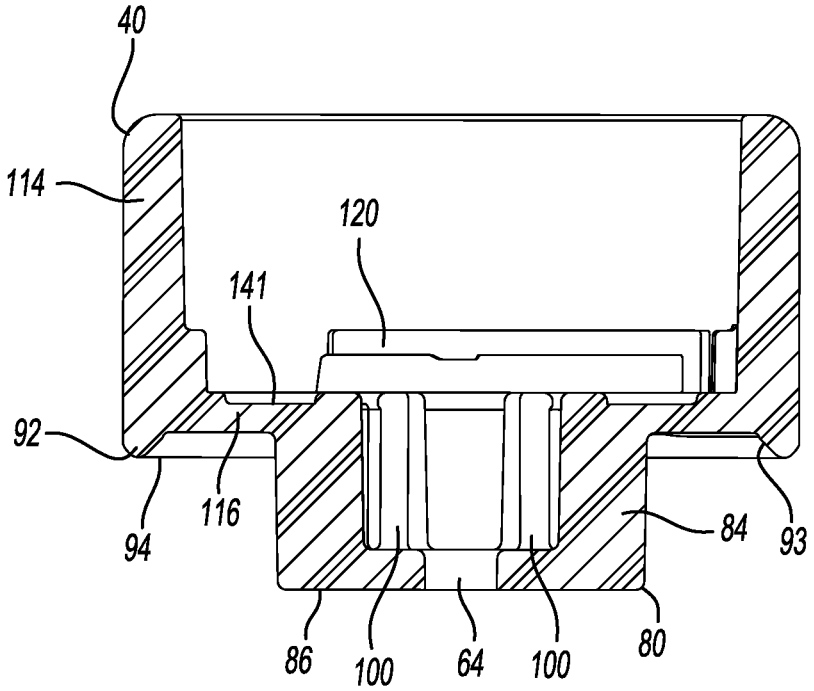
FIG. 15 is a cross-sectional view of the sensor housing.

Referring now specifically to FIGS. 11, 12 and 13, a plug 130 includes a first wall 132 and a second wall 134. The walls 132, 134 may be radially extending from the first wall 84. As will be described below, the plug 130 may fit into a receptacle formed within the recessed opening 70 of the underlisting 50.

The engagement surface 120 may rotationally engage the removable housing 60. An indicator 122 may be used to indicate the direction of rotation for securing the recessed housing within the sensor housing 40. The indicator 122 may also have an indicator 122*a* to indicate an insertion orientation of the removable housing 60 and an indicator 122B to indicate the locked position of the removable housing 60.

Figure 18:
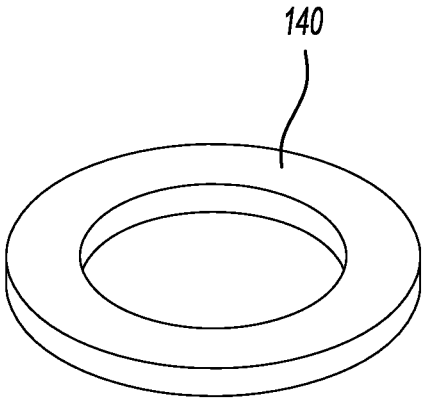
FIG. 18 is a perspective view of a washer for use within the sensor housing.
Figure 19:
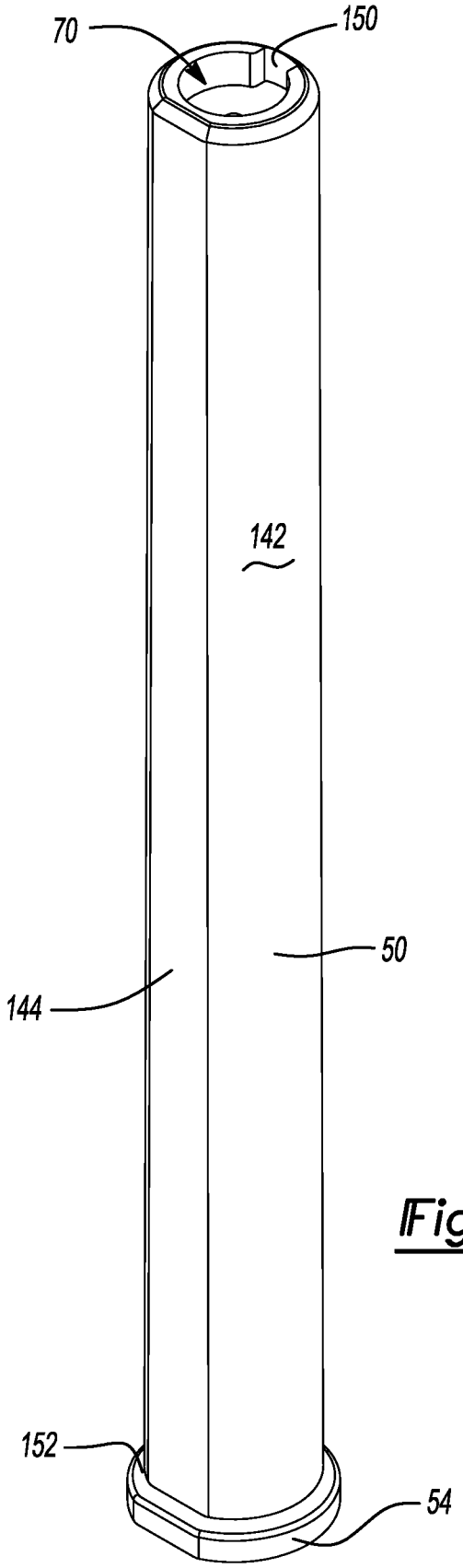
FIG. 19 is a perspective view of the underlisting.
Figure 20:
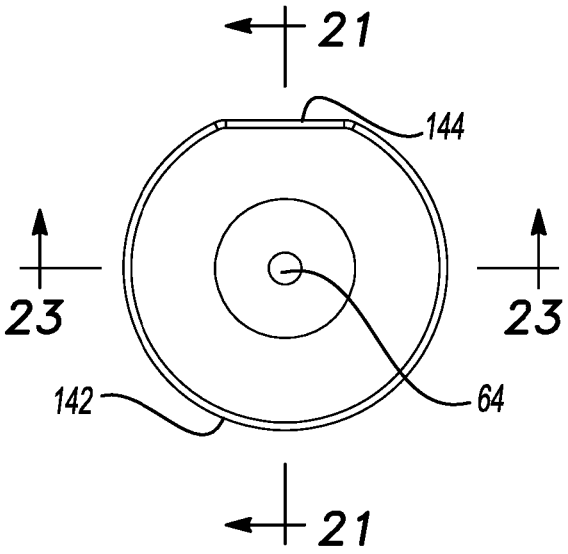
FIG. 20 is an end view of the underlisting.
Figure 21:
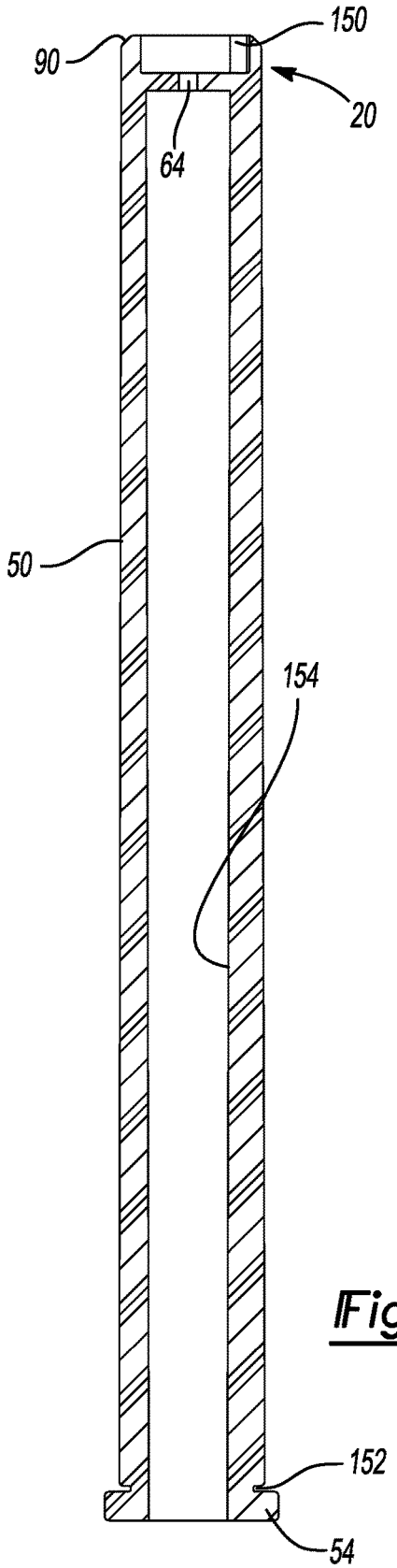
FIG. 21 is a cross-sectional view of the underlisting along line 2121 of FIG. 20.
Figure 22:
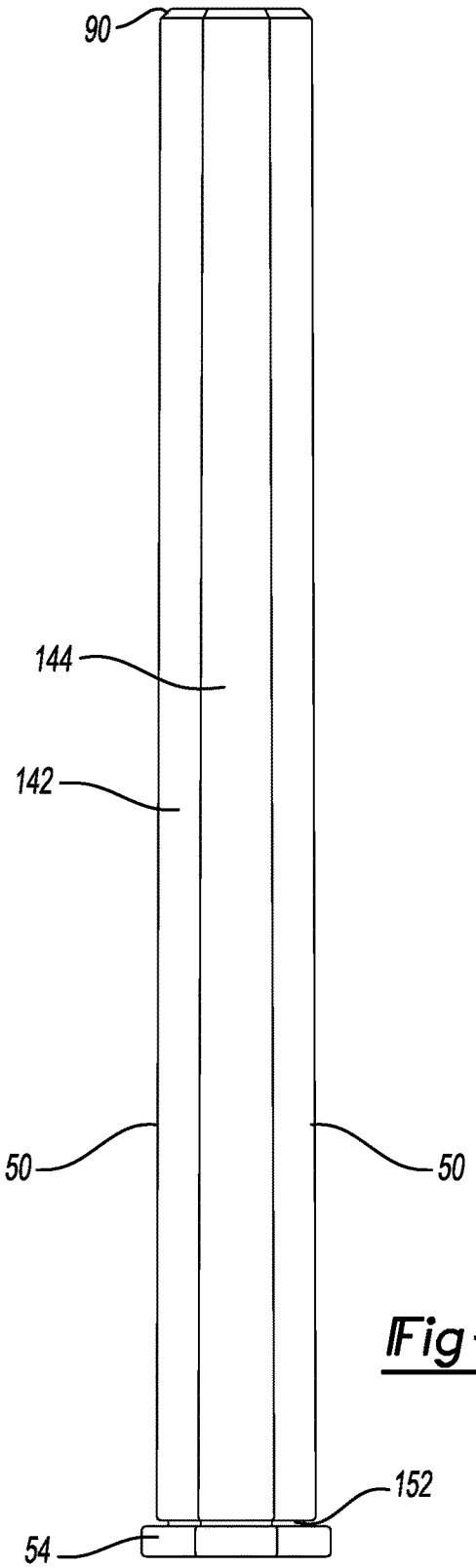
FIG. 22 is a front side view of the underlisting.
Figure 23:
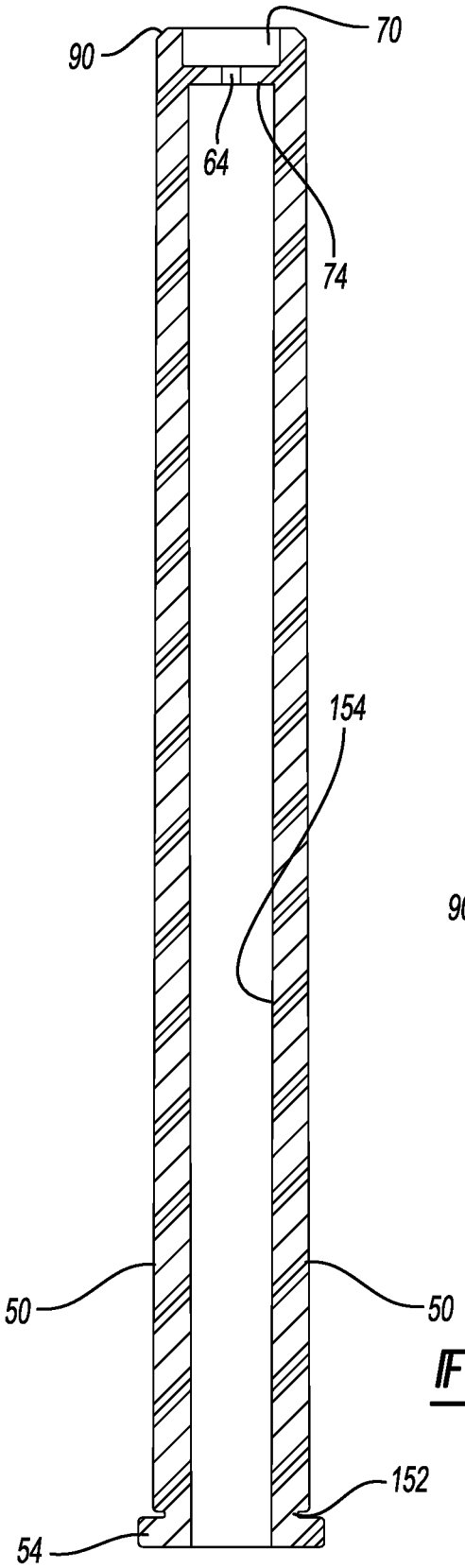
FIG. 23 is a cross-sectional view along line 2323 of FIG. 20.
Figure 24:
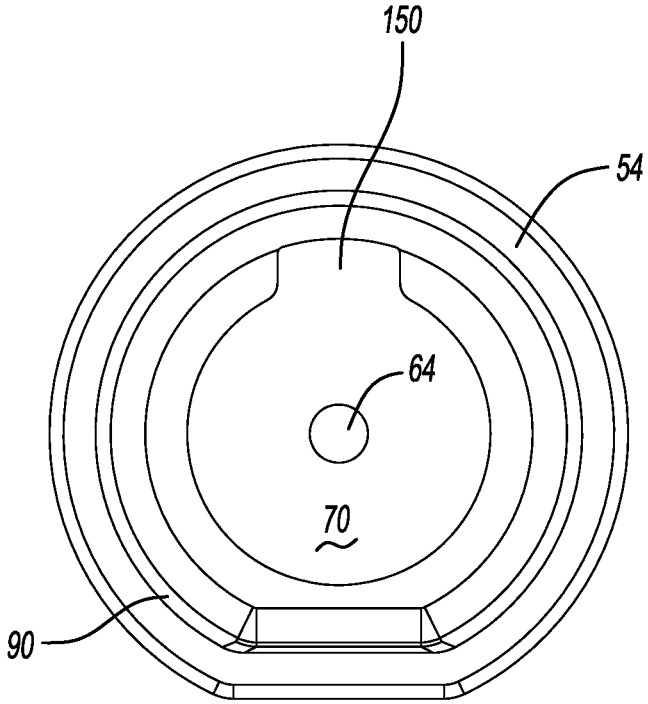
FIG. 24 is a top end view of the underlisting.
Figure 25:
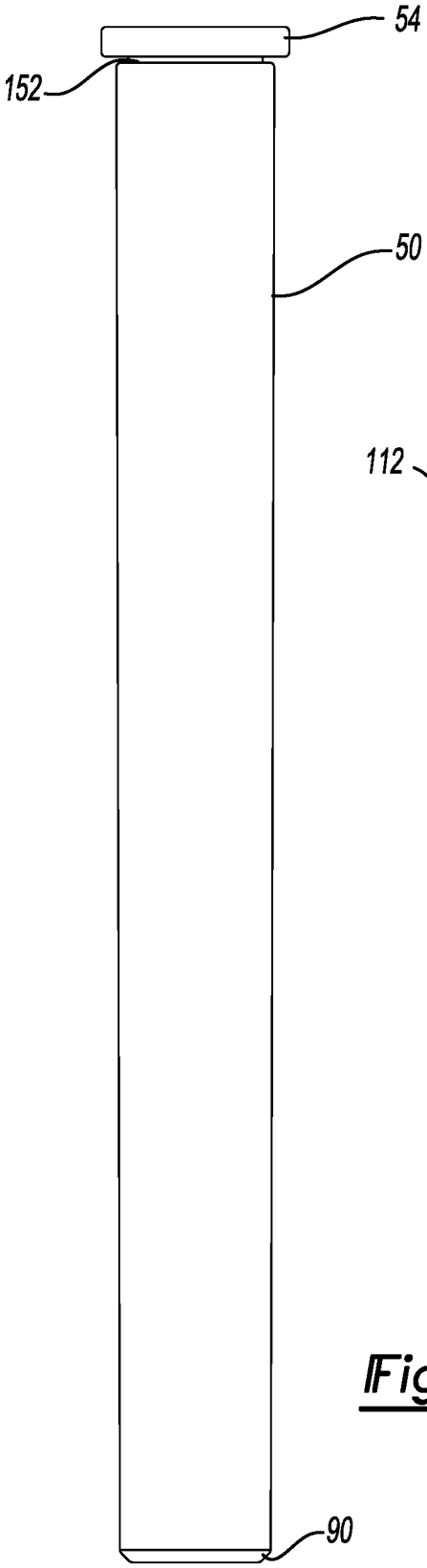
FIG. 25 is side view of the underlisting.
Figure 26:
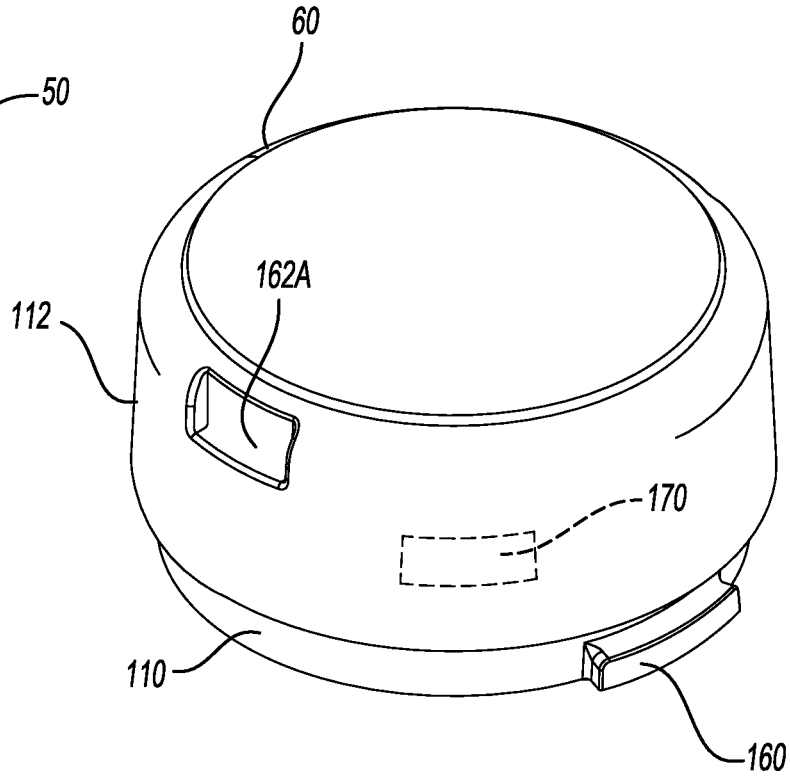
FIG. 26 is a perspective view of the removable housing.
Figure 27:
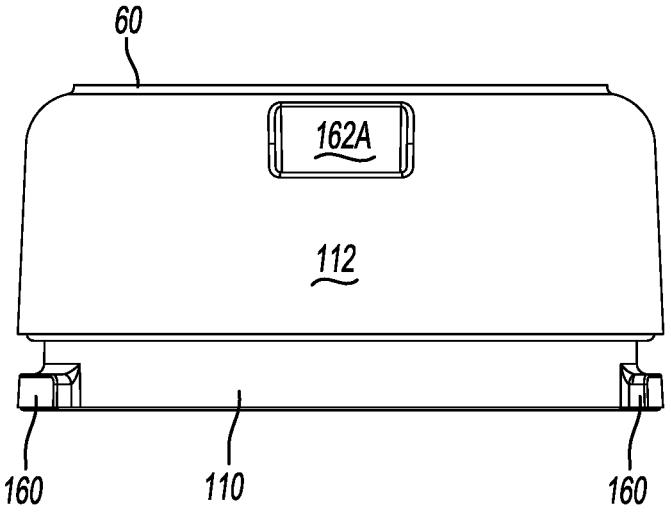
FIG. 27 is a first side view of the removable housing.
Figure 28:
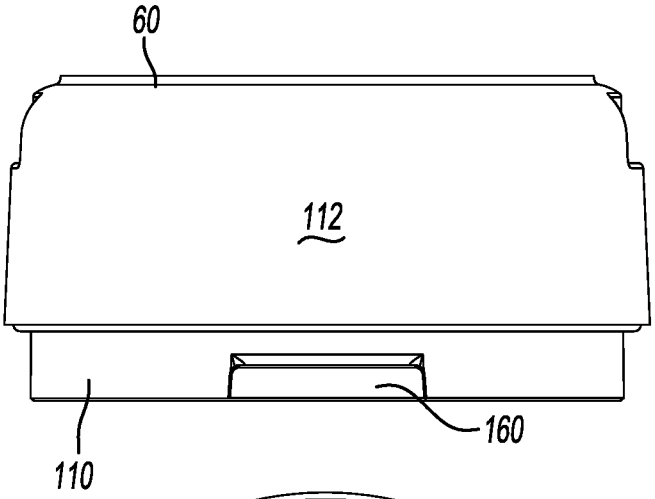
FIG. 28 is another side view of the removable housing.

Referring now to FIG. 18, the washer 140 is round in shape and made of a compliant material to help provide a resistant force so that the recessing housing 60 cannot easily be removed from the second portion 82 of the sensor housing 40 when locked in place.

Referring now to FIGS. 19-25, the underlisting 50 is illustrated in further detail. The underlisting 50 has a first wall 142 that corresponds to the wall 42 of the grip. The underlisting 50 also has a second wall 144 which is flat. Ultimately, the outer gripping layer 52 illustrated in FIGS. 1 and 2 will conform to the shape of the underlisting 50. In this example, a curved or cylindrical wall 142 extends around most of the circumference of the underlisting 50. The chamfer 90 is visible in FIG. 19. The chamfer 90 extends around the circumference of the underlisting 50.

Within the outer wall of the underlisting, a receptacle 150 is formed in a thin portion of the wall 42. In this example, the receptacle 150 is directly opposite the flat wall 144. The receptacle 150 has a width sized to receive the plug 130 illustrated in FIG. 10. In this example, one width is sized to accommodate both walls 132 and 134. That is, the width of the receptacle 150 extends from the furthest edges of the walls 132 and 134. Adhesive may be used on the wall 132 to secure the walls 132, 134 within the receptacle 150.

As is best illustrated in FIGS. 22, 23, 24 and 26, a groove 152 may be disposed directly adjacent to the flange 54 at the first end of the underlisting 50. The groove 152 is sized to receive a first edge of the gripping member.

Figure 29:
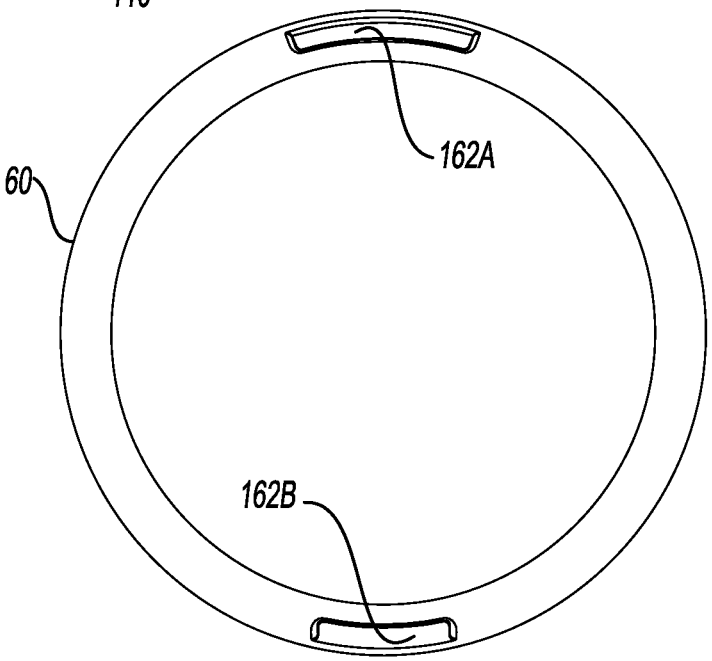
FIG. 29 is a top view of the removable housing.
Figure 30:
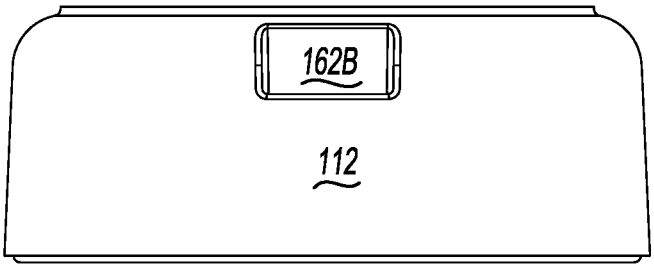
FIG. 30 is a side view of the second portion of the removable housing.
Figure 31:
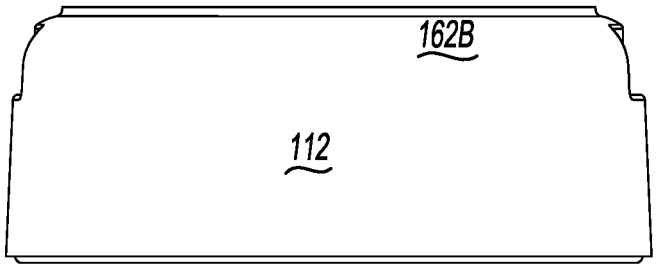
FIG. 31 is another side view of the second portion of the removable housing.
Figure 32:
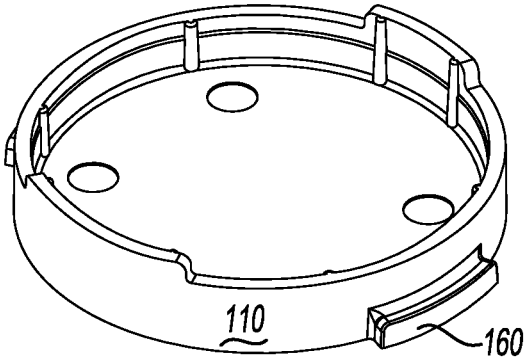
FIG. 32 is a perspective view of the first portion 110 of the removable housing 60.
Figure 33:
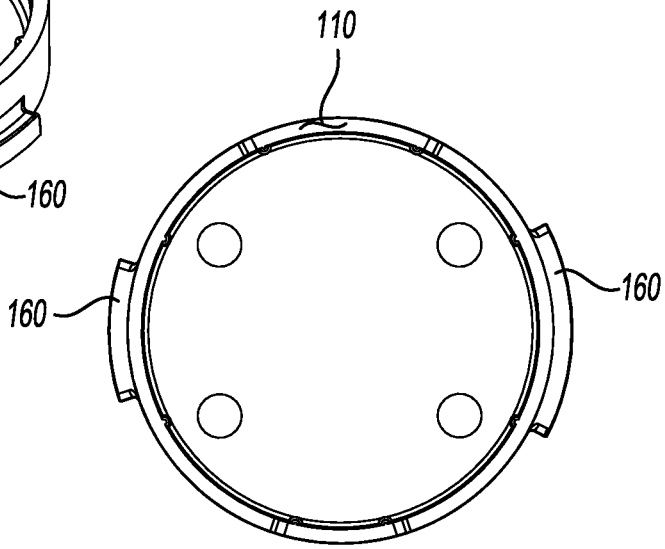
FIG. 33 is a top view of the first portion 110 of the removable housing 60.

Referring now to FIGS. 26-33, a removable housing 60 is illustrated. The removable housing 60 has two tabs 160 that are used for engaging the engagement surfaces 120 illustrated in FIGS. 9, 10, 15 and 16. The tabs 160 extend from the first portion 110 of the removable housing 60. The first portion 110 may be glued or otherwise affixed to the second portion 112 of the removable housing 60. Recessed portions 162 formed near the upper edge of the removable housing 60 may help engage or disengage a device or tool for rotating the removable housing 60 within the second portion 82 of the sensor housing 40. The recessed portions 162 may be differently sized and located directly opposite of each other as is best illustrated in FIG. 29. FIG. 29 also shows the circumferential length of the recessed portions 162 may also be different. That is, one recess 162A may be shorter in length than a longer recess 162B.

An electronics module 170 may be disposed within the removable housing 60. The electronics module 170 may include a sensor for sensing the position and/or rotational movement of the golf club at the position occupied by the electronics module 170.

Figure 34:
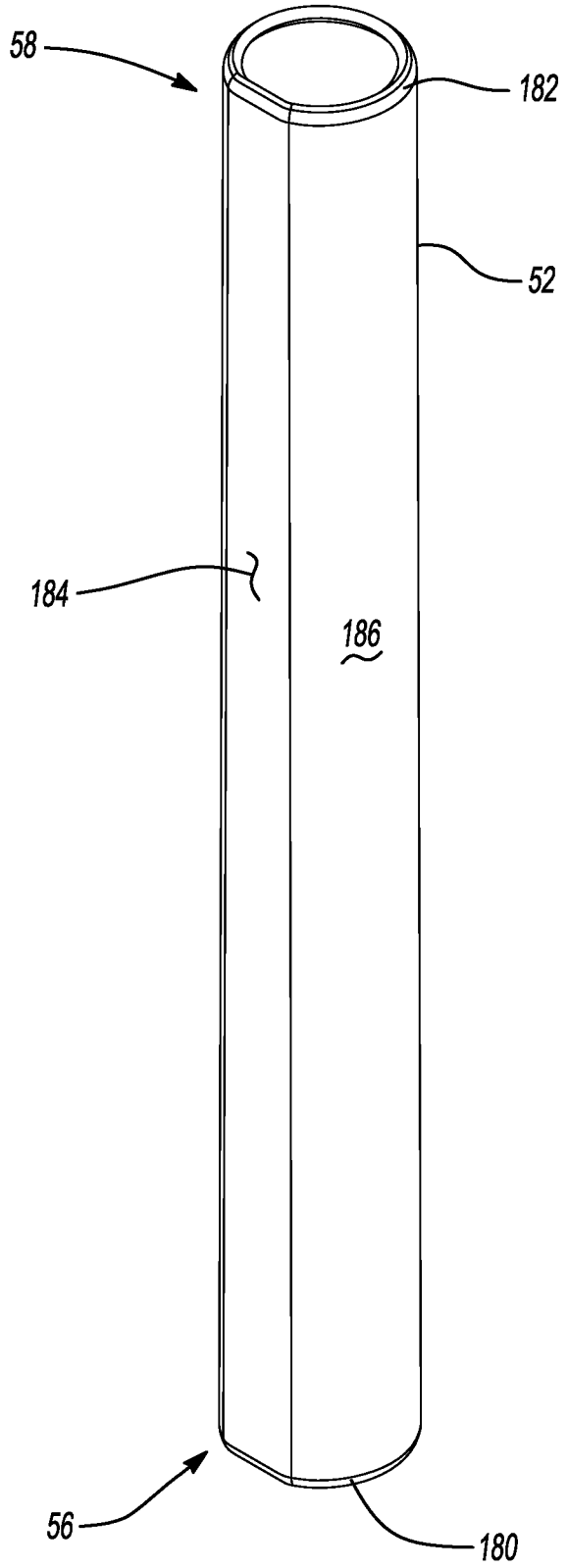
FIG. 34 is a perspective view of the gripping layer 52.

Referring now to FIG. 34, the gripping layer 52 is illustrated in further detail. The gripping layer 52 has outer surfaces 184 and 186. Outer surface 184 corresponds and conforms to the flat side 144 of the underlisting 50. Outer surface 186 corresponds and conforms to curved side 142 of the underlisting 50. The gripping layer 52 includes a first edge 180 at the first end 56 and a second edge 182 at the second end 58. The first edge 180 is to be received within the groove 152 illustrated in FIGS. 21-25. The top edge 182 is received within the channel 192 between the lip 92 and the chamfer 90 illustrated in FIG. 8.

During assembly, the gripping layer 52 may be applied to the underlisting 50. The upper edge 182 of the gripping layer 52 may be received by the lip 92 and the inner surface of the lip 92. As the removable housing 60 is placed into the recessed opening, the upper edge 182 is pinched or secured within. The channel 94. The upper edge 182 is thus pressed between the chamfer 90 and the surface 93 of the lip 92. The removable housing 60 may be assembled after or before the sensor housing 40 is coupled to the underlisting 50. Adhesive may be applied between the underlisting 50 (walls 72 and 74) or on the walls 84 and 86 or both of the first portion 80 before coupling the sensor housing 40 and underlisting 50.

As the removable housing 60 is inserted into the second portion 82, the washer 140 may be slightly compressed.

Those skilled in the art can now appreciate from the foregoing description that the broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification and the following claims.

What is claimed is:

1. A golf club grip for a golf club comprising: an elongated member having a first end, a second end, an inner surface and an outer surface, the first end is configured to receive a golf club shaft, the second end includes a recessed opening, said recessed opening extending away from the second end longitudinally toward the first end; a sensor housing comprising a first portion and a second portion, said first portion received within the recessed opening, said first portion coupling the sensor housing to the elongated member and having an outer wall, said second portion receiving a removable housing therein; and the recessed opening comprising a unitary receptacle having a width wherein said first portion comprises a plug comprising a first U-shaped wall extending from the outer wall back to the outer wall and a second U-shaped wall extending from the outer wall back to the outer wall so that a portion of the outer wall is between the first U-shaped wall and the second U-shaped wall, each of the first U-shaped wall and the second U-shaped wall comprising three exposed surfaces, each of the surfaces being generally normal to its adjacent surfaces, each of the first wall and second wall extending longitudinally so that respective furthest edges of the first U-shaped wall and the second U-shaped wall extend the width of the receptacle and are adhesively coupled to the first wall and second wall of the first portion, respectively, wherein the first U-shaped wall and the second U-shaped wall are received in the unitary receptacle.

2. The golf club grip of claim 1, wherein the recessed opening is substantially cylindrical in shape.

3. The golf club grip of claim 2, wherein the first portion is substantially cylindrical in shape.

4. The golf club grip of claim 1, wherein a shape of the first portion substantially corresponds to a shape of the recessed opening.

5. The golf club grip of claim 1, wherein the second portion is substantially cylindrical in shape.

6. The golf club grip of claim 1, wherein the elongated member comprises an underlisting and a gripping layer disposed around the underlisting.

7. The golf club grip of claim 6, wherein the underlisting has a groove at the first end and the gripping layer has a first edge received in the groove.

8. The golf club grip of claim 7, wherein the underlisting comprises a flange at the first end, said groove disposed adjacent to the flange.

9. The golf club grip of claim 6, wherein the underlisting comprises a chamfer at the second end and the gripping layer has a second edge adjacent to the chamfer.

10. The golf club grip of claim 9, wherein the chamfer and the second portion of the housing define a channel receiving the second edge.

11. The golf club grip of claim 10, further comprising a lip longitudinally extending from a bottom surface of the second portion of the sensor housing, said lip forming the channel.

12. The golf club grip of claim 1, wherein the first portion of the sensor housing comprises a first diameter and the second portion has a second diameter greater than the first diameter.

13. The golf club grip of claim 1, wherein the housing is hollow and comprises a sensor therein.

14. A golf club grip for a golf club comprising:

an elongated member having a first end, a second end, an inner surface and an outer surface, the first end is configured to receive a golf club shaft, the second end includes a recessed opening, said recessed opening extending away from the second end longitudinally toward the first end;

a sensor housing comprising a first portion and a second portion, said first portion received within the recessed opening, said first portion coupling the sensor housing to the elongated member, said second portion receiving a removable housing therein; and said elongated member comprises an underlisting and a gripping layer disposed around the underlisting, the underlisting comprises a chamfer at the second end and the gripping layer has a second edge adjacent to the chamfer, the chamfer and the second portion of the housing define a channel receiving the second edge.

15. The golf club grip of claim 14, further comprising a lip longitudinally extending from a bottom surface of the second portion of the sensor housing, said lip forming the channel.

16. The golf club grip of claim 14, wherein the first portion of the sensor housing comprises a first diameter and the second portion has a second diameter greater than the first diameter.

17. The golf club grip of claim 14, wherein the recessed opening is substantially cylindrical in shape.

18. The golf club grip of claim 17, wherein the first portion is substantially cylindrical in shape.

19. The golf club grip of claim 14, wherein a shape of the first portion substantially corresponds to a shape of the recessed opening.

20. The golf club grip of claim 14, wherein the second portion is substantially cylindrical in shape.

21. The golf club grip of claim 14, wherein the underlisting has a groove at the first end and the gripping layer has a first edge received in the groove.

22. The golf club grip of claim 21, wherein the underlisting comprises a flange at the first end, said groove disposed adjacent to the flange.

* * * * *